US008737891B2

(12) United States Patent
Hanatani

(10) Patent No.: US 8,737,891 B2
(45) Date of Patent: May 27, 2014

(54) BELT DRIVING APPARATUS, BELT UNIT, AND IMAGE FORMING APPARATUS

(75) Inventor: Junji Hanatani, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 307 days.

(21) Appl. No.: 13/087,940

(22) Filed: Apr. 15, 2011

(65) Prior Publication Data

US 2012/0114397 A1 May 10, 2012

(30) Foreign Application Priority Data

Nov. 9, 2010 (JP) ..... 2010-250805

(51) Int. Cl.
*G03G 15/01* (2006.01)

(52) U.S. Cl.
USPC ..... 399/302

(58) Field of Classification Search
USPC ..... 399/302, 303, 312, 313, 308, 162; 198/832.2, 832.3, 813, 814, 782; 193/35 A; 242/420.4, 535.4, 541.3; 226/170–173; 474/101, 109, 110, 111, 474/113, 136, 137; 271/275, 198
See application file for complete search history.

(56) References Cited

U.S. PATENT DOCUMENTS

| | | | | |
|---|---|---|---|---|
| 1,257,660 | A * | 2/1918 | Willis | 474/109 |
| 2,963,236 | A * | 12/1960 | Grosser et al. | |
| 4,314,631 | A * | 2/1982 | Hagerman et al. | 198/832.3 |
| 6,078,777 | A * | 6/2000 | Imumi et al. | 399/313 |
| 8,200,124 | B2 * | 6/2012 | Nakano | 399/312 |
| 2004/0062569 | A1 * | 4/2004 | Lin et al. | 399/162 |
| 2008/0193173 | A1 * | 8/2008 | Meguro et al. | 399/313 |

FOREIGN PATENT DOCUMENTS

| | | |
|---|---|---|
| JP | A-10-232566 | 9/1998 |
| JP | A-11-24507 | 1/1999 |
| JP | A-2003-270887 | 9/2003 |
| JP | A-2007-286383 | 11/2007 |

* cited by examiner

*Primary Examiner* — Susan Lee
(74) *Attorney, Agent, or Firm* — Oliff PLC

(57) ABSTRACT

A belt driving apparatus includes an endless belt stretched around a driving roller that drives the belt, a receiving roller that receives an external force through the belt, driven rollers arranged upstream of the receiving roller and downstream of the driving roller in a rotational direction of the belt, at least one of the driven rollers being supported to be movable in radially inward and outward directions of the belt in accordance with a tension in the belt. A braking unit performs braking by pressing a frictional member against a rotational shaft of one of the driven rollers and generating a frictional force, and converts a displacement of the movably supported driven roller in the radially outward direction into a relative displacement between the rotational shaft and the frictional member, the displacement being caused when the external force is applied to the receiving roller so as to decelerate rotation thereof.

21 Claims, 13 Drawing Sheets

BELT DRIVING APPARATUS, BELT UNIT, AND IMAGE FORMING APPARATUS

CROSS-REFERENCE TO RELATED APPLICATIONS

This application is based on and claims priority under 35 USC 119 from Japanese Patent Application No. 2010-250805 filed Nov. 9, 2010.

BACKGROUND

The present invention relates to a belt driving apparatus, a belt unit, and an image forming apparatus.

SUMMARY

According to an aspect of the invention, there is provided a belt driving apparatus including an endless belt stretched around plural rollers; a driving roller that rotationally drives the belt, the driving roller being one of the rollers; a receiving roller that receives an external force through the belt, the receiving roller being another one of the rollers; one or more driven rollers rotated by rotation of the belt and arranged in an area that is upstream of the receiving roller and downstream of the driving roller in a rotational direction of the belt, the driven rollers being the remaining ones of the rollers, at least one of the driven rollers being supported to be movable in radially inward and outward directions of the belt in accordance with a tension in the belt; and a braking unit that performs braking by pressing a frictional member against a rotational shaft of one of the driven rollers and generating a frictional force, the braking unit including a mechanism that converts a displacement of the movably supported driven roller in the radially outward direction of the belt into a relative displacement between the rotational shaft and the frictional member, the displacement of the movably supported driven roller being caused when the external force is applied to the receiving roller so as to decelerate rotation thereof.

BRIEF DESCRIPTION OF THE DRAWINGS

An exemplary embodiment of the present invention will be described in detail based on the following figures, wherein:

FIGS. 7A to 7D illustrate the positional relationship between a frictional member included in a braking unit and a rotational shaft of a braking displacement roller in the belt driving apparatus according to the first exemplary embodiment illustrated in FIG. 4, wherein FIG. 7A shows a steady state, FIG. 7B shows the state in which the braking force is reduced, FIG. 7C shows the state in which the braking force is increased, and FIG. 7D shows the state in which the frictional member and the rotational shaft are separated from each other;

DETAILED DESCRIPTION

An image forming apparatus in which a belt driving apparatus according to an exemplary embodiment of the present invention may be included will be described, and then belt driving apparatuses according to exemplary embodiments of the present invention will be explained in detail.

1. Exemplary Embodiment of Image Forming Apparatus

Figure 1:
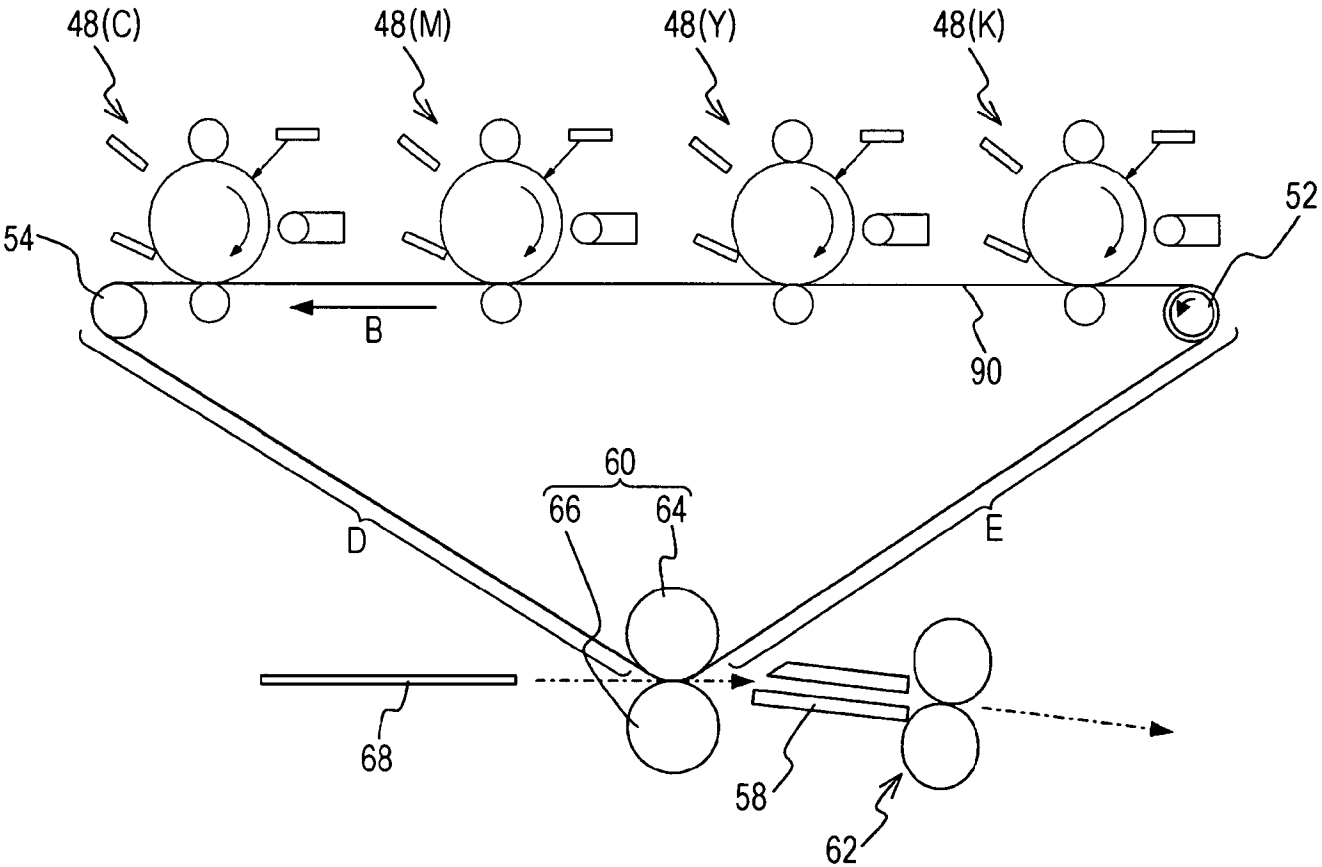
FIG. 1 is a schematic diagram illustrating the structure of an example of a tandem color image forming apparatus in which a belt driving apparatus according to an exemplary embodiment of the present invention may be included.

FIG. 1 is a schematic diagram illustrating the structure of a tandem color image forming apparatus as an example of an image forming apparatus in which a belt driving apparatus according to an exemplary embodiment of the present invention may be included. Characteristic parts of exemplary embodiments of the present invention are not shown in FIG. 1. This image forming apparatus basically includes four image forming units 48Y, 48M, 48C, and 48K that respectively form yellow (Y), magenta (M), cyan (C), and black (K) unfixed toner images based on image information by electrophotography; an intermediate transfer belt 90 onto which the unfixed toner images formed by the image forming units 48 (48Y, 48M, 48C, and 48K) are transferred in a superimposed manner; a second transfer device 60 that transfers the unfixed toner images on a surface of the intermediate transfer belt 90 onto a sheet 68 of paper, which is an example of a recoding medium; and a fixing device 62 that fixes the unfixed toner images on the sheet 68 by applying heat and pressure. The arrowed dotted chain line in FIG. 1 shows a transporting path of the sheet 68. The sheet 68 is supplied one by one from a sheet feeding unit (not shown).

The image forming units 48Y, 48M, 48C, and 48K are arranged parallel to each other along a horizontal direction with constant intervals therebetween. The structure of each of the image forming units 48Y, 48M, 48C, and 48K will be described.

Figure 2:
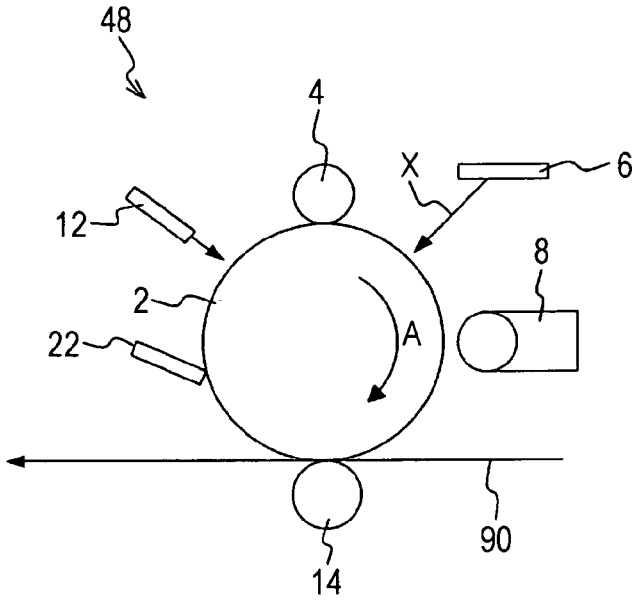
FIG. 2 is a schematic diagram illustrating the structure of each image forming unit shown in FIG. 1.

FIG. 2 is a schematic diagram illustrating the structure of each of the image forming units 48 (48Y, 48M, 48C, and 48K). Each image forming unit 48 basically includes a cylindrical photoconductor drum 2 which is uniformly charged and is then irradiated with image light so that a latent image is formed on the surface of the photoconductor drum 2. A charging device 4, an exposure device 6, a developing device 8, a first transfer device 14, which is an example of a first transfer unit, a cleaning device 22, and an erase lamp 12 are arranged around the photoconductor drum 2. The charging device 4 uniformly charges the surface of the photoconductor drum 2. The exposure device 6 irradiates the photoconductor drum 2 with image light so as to form the latent image on the surface thereof. The developing device 8 forms a toner image by selectively transferring toner to the latent image on the surface of the photoconductor drum 2. The first transfer device 14 transfers the toner image formed on the surface of the photoconductor drum 2 onto the intermediate transfer belt 90. The cleaning device 22 collects the toner that remains on the surface of the photoconductor drum 2. The erase lamp 12 eliminates the electric potential that remains on the surface of the photoconductor drum 2.

The photoconductor drum 2 is an example of an image carrier and has a drum-like shape as a whole. A photosensitive layer is provided on the outer peripheral surface (drum surface) of the photoconductor drum 2. The photoconductor drum 2 is rotatable in the direction shown by arrow A in FIG. 2.

The photoconductor drum 2 at least has a function of allowing a latent image (electrostatic latent image) to be formed thereon. An electrophotographic photoconductor is preferably used as the electrostatic latent image carrier. The photoconductor drum 2 is produced by forming the photosensitive layer, such as an organic photosensitive layer, on the outer peripheral surface of a conductive cylindrical base. In general, an undercoat layer for the photosensitive layer is formed on the surface of the base as necessary, and the photosensitive layer is formed thereon by stacking a charge generating layer containing a charge generating substance and a charge transporting layer containing a charge transporting substance in that order. The order in which the charge generating layer and the charge transporting layer are stacked may be reversed.

The above-described examples are examples of multilayer photoconductors in which the charge generating substance and the charge transporting substance are contained in different layers (the charge generating layer and the charge transporting layer) that are stacked together. Single layer photoconductors, in which both the charge generating substance and the charge transporting substance are contained in a single layer, may be used instead. However, preferably, a multilayer photoconductor is used. An intermediate layer may be provided between the undercoat layer and the photosensitive layer. The photosensitive layer is not limited to an organic photosensitive layer, and may be another type of photosensitive layer, such as an amorphous silicon photosensitive film.

The charging device 4 uniformly charges the surface of the photoconductor drum 2. A charging roller, which is a conductive or semiconductive contact charging device, may be used as the charging device 4. Alternatively, a non-contact charging device, such as a corotron, may be used. In the case where the charging roller is used, a direct current or a current obtained by superimposing an alternating current on a direct current may be applied to the photoconductor drum 2. The charging device 4 charges the surface of the photoconductor drum 2 by generating an electric discharge in a small space around contacting portions between the charging device 4 and the photoconductor drum 2.

The surface of the photoconductor drum 2 is generally charged to −300 V to −1,000 V by the charging device 4. The conductive or semiconductive charging roller may either have a single layer structure or a multilayer structure. A mechanism for cleaning the surface of the charging roller may be additionally provided.

The exposure device 6 irradiates the photoconductor drum 2 that has been uniformly charged by the charging device 4 with light X corresponding to an image, thereby forming an electrostatic latent image. The exposure device 6 is not particularly limited, and may be, for example, an optical device which irradiates the surface of the electrostatic latent image carrier with light, such as semiconductor laser light, light emitting diode (LED) light, or liquid crystal shutter light, in accordance with a desired image.

The developing device 8 has a function of developing the latent image formed on the electrostatic latent image carrier with developer including toner to form a toner image. The developing device 8 is not particularly limited as long as the above-described function is provided, and various types of developing devices may be used as appropriate. For example, a developing device containing two-component developer including toner for developing the electrostatic latent image and magnetic carrier may be used. In the developing device, the toner is caused to adhere to the photoconductor drum 2 by a magnetic brush formed of the magnetic carrier. In a developing process, a direct current voltage is generally applied to the photoconductor drum 2. However, a voltage obtained by superimposing an alternating current voltage on a direct current voltage may be applied instead.

The developing device 8 in the image forming unit 48Y contains yellow toner, the developing device 8 in the image forming unit 48M contains magenta toner, the developing device 8 in the image forming unit 48C contains cyan toner, and the developing device 8 in the image forming unit 48K contains black toner.

The first transfer device 14 transfers the toner image formed on the surface of the photoconductor drum 2 onto the outer peripheral surface of the endless intermediate transfer belt 90 while the intermediate transfer belt 90 is nipped between the first transfer device 14 and the photoconductor drum 2 (first transfer process).

The first transfer device 14 may be, for example, a device that transfers the toner image onto the surface of the intermediate transfer belt 90 with an electrostatic force by applying an electric charge having a polarity opposite to that of the toner forming the toner image from the inner side of the intermediate transfer belt 90. Alternatively, a transfer roller and a transfer roller pressing device may be used, the transfer roller being a conductive or semiconductive roller that transfers the toner image by coming into direct contact with the inner surface of the intermediate transfer belt 90.

The transfer roller receives a transfer current to be applied to the photoconductor drum 2. The transfer current may either be a direct current or a current obtained by superimposing an alternating current on a direct current. The conditions and specifications of the transfer roller are set as appropriate in accordance with, for example, the width of an image area to be charged and the shape, opening width, and peripheral speed of a transfer charging device. To reduce costs, a single-layer foam roller or the like is preferably used as the transfer roller.

The cleaning device 22 cleans (removes) the toner and the like that remain on the surface of the photoconductor drum 2 after the transfer process. In the present exemplary embodiment, a blade cleaning device is used as the cleaning device 22. However, other types of cleaning devices, such as a brush cleaning device and a roller cleaning device, may instead be used as long as they are capable of removing the toner that remains on the surface of the photoconductor drum 2. In particular, a cleaning blade is preferably used. Urethane rubber, neoprene rubber, silicone rubber, etc., may be used as the material of the cleaning blade. In particular, polyurethane elastic material is preferably used since it has high abrasion resistance.

In the case where toner having a high transfer efficiency is used, the cleaning device 22 may be omitted.

In each image forming unit 48, the surface of the photoconductor drum 2 is uniformly charged by the charging device 4, and a latent image of each color (yellow (Y), magenta (M), cyan (C), and black (K)) based on image information is formed by the exposure device 6. Then, an unfixed toner image corresponding to the latent image is formed on the photoconductor drum 2 by the developing device 8 which contains the toner of each color. The structure of each image forming unit 48 excluding the photoconductor drum 2 corresponds to an example of a "toner-image forming unit" according to an exemplary embodiment of the present invention. The unfixed toner images of the respective colors formed on the surfaces of the photoconductor drums 2 in the respective image forming units 48 are successively transferred onto the intermediate transfer belt 90 in a superimposed manner by the first transfer devices 14.

The intermediate transfer belt 90 is stretched around multiple rollers, which include a driving roller 52 that is rotated by a rotational drive source (not shown), a support roller 54 that is rotationally driven and that supports the intermediate transfer belt 90, a receiving roller 64 included in the second transfer device 60, and one or more driven rollers (described below) that are not illustrated in FIG. 1. The intermediate transfer belt 90 passes through first transfer positions of the photoconductor drums in the image forming units 48 in an area between the driving roller 52 and the support roller 54. The intermediate transfer belt 90 is rotated in the direction shown by arrow B by the driving roller 52.

As is well known, in the case where a tension roller is provided to apply a certain tension to the intermediate transfer belt 90, the tension roller also contributes to stretching the intermediate transfer belt 90. Also in the present exemplary embodiment, a tension roller is preferably provided to apply a desired tension. However, the tension roller is not illustrated in the drawings. The tension roller serves as one of "driven rollers" according to an exemplary embodiment of the present invention. The tension roller may also have an additional function. In the following description, explanations of the tension roller will be omitted.

The intermediate transfer belt 90 is not particularly limited, and an existing intermediate transfer belt may be used without problem. For example, an intermediate transfer belt having a two-layer structure including a belt base member and a surface layer stacked thereon may be used.

Examples of materials of the intermediate transfer belt 90 include polycarbonate resin (PC), polyvinylidene fluoride (PVDF), polyalkylene phthalate, a blended material of PC and polyalkylene terephthalate (PAT), a blended material of ethylene tetrafluoroethylene copolymer (ETFE) and PC, a blended material of ETFE and PAT, and a blended material of PC and PAT. In view of mechanical strength, an intermediate transfer belt made of thermosetting polyimide resin is preferably used.

The second transfer device 60 basically includes the receiving roller 64 and a second transfer roller 66 which are arranged so as to face each other with the intermediate transfer belt 90 nipped therebetween. The sheet 68 is guided through a nip section formed between the second transfer roller 66 and the intermediate transfer belt 90. The unfixed toner images on the surface of the intermediate transfer belt 90 are transferred onto the surface of the sheet 68 by causing an electrostatic interaction. The second transfer device 60 is not particularly limited, and an existing transfer device may be used without problem. For example, a transfer device having a structure similar to that of the above-described first transfer device 14 may be used.

The fixing device 62 fixes the toner images that have been transferred onto the recording medium by applying one or both of heat and pressure. In the present exemplary embodiment, the fixing device 62 is a double-roller fixing device. Alternatively, a belt-roller nipping fixing device in which one of heating and pressing components is belt shaped and the other is roller shaped or a double-belt fixing device in which both the heating and pressing components are belt shaped may be used. The fixing device may include a belt that is stretched around multiple rollers. Alternatively, a free-belt-nip type fixing device in which the belt is not stretched may be used. Either type of fixing device may be used in an exemplary embodiment of the present invention.

The sheet 68 onto which the toner images are transferred to form a final recording image may be for example, a sheet of plain paper or an overhead projector (OHP) sheet used in an electrophotographic copier, a printer, or the like. To increase the smoothness of the surface having the image fixed thereon, the surface of the recording medium is preferably as smooth as possible. Accordingly, for example, coated paper formed by coating the surface of plain paper with resin or the like or art paper for printing may be used.

The process of forming a color image performed by the image forming apparatus according to the present exemplary embodiment having the above-described basic structure will be described.

First, in the image forming units 48, the unfixed toner images of four colors are formed on the photoconductor drums 2 and are successively transferred onto the surface of the intermediate transfer belt 90 in a superimposed manner by an electrostatic transferring operation performed by the first transfer devices 14. Thus, the first transfer process is performed.

The unfixed toner images that have been transferred onto the intermediate transfer belt 90 are transported by the rotation of the intermediate transfer belt 90, and are caused to pass through the second transfer device 60. Thus, the unfixed toner images are transferred onto the sheet 68. The unfixed toner images on the surface of the intermediate transfer belt 90 are electrostatically transferred onto the sheet 68 while being in contact therewith when the sheet 68 is guided through the nip section between the receiving roller 64 and the second transfer roller 66 together with the intermediate transfer belt 90.

The sheet 68 onto which the toner images have been transferred is ejected from the second transfer device 60, and is guided through a transporting guide 58 to the fixing device 62, where the toner images are fixed. Then, the sheet 68 is ejected from the system. Thus, a full-color image is formed on one side of the sheet 68.

In the above-described image forming apparatus, when the sheet 68 enters the second transfer device 60 along the path shown by the arrowed dotted chain line, the movement of the intermediate transfer belt 90 in the direction shown by arrow B and the rotation of the receiving roller 64 are decelerated by a resistance based on the thickness of the sheet 68. More specifically, when the sheet 68 is a sheet of thick paper, the entrance of the sheet 68 generates an external force that is applied to the transporting system in the image forming apparatus such as to decelerate the rotation of the receiving roller 64. The external force tends to increase as the thickness of the sheet 68 increases.

Figure 3:
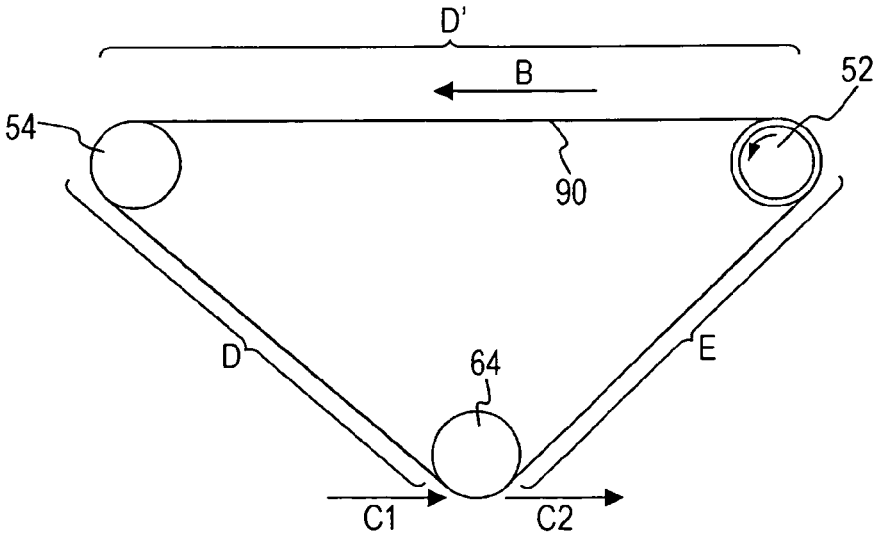
FIG. 3 is a schematic diagram illustrating the structure of a transporting system in the image forming apparatus shown in FIG. 1 for explaining the effect of an external force applied to the transporting system.

The effect of the above-described external force applied to the transporting system in the image forming apparatus will be described with reference to FIG. 3. FIG. 3 is a schematic diagram illustrating only the transporting system in the image forming apparatus illustrated in FIG. 1. When the sheet 68 is transported in the direction shown by arrow C1 and enters the section between the second transfer roller 66 and the receiving roller 64 that face each other with the intermediate transfer belt 90 nipped therebetween (see FIG. 1), the resistance based on the thickness of the sheet 68 is generated. Accordingly, the movement of the intermediate transfer belt 90 in the direction shown by arrow B and the rotation of the receiving roller 64 are decelerated.

Although the rotation of the receiving roller 64 is decelerated, the driving roller 52 continues to rotate at a constant speed. Therefore, the intermediate transfer belt 90 becomes slack in a first area D and a first area D' which are upstream of the receiving roller 64 and downstream of the driving roller 52 in the moving direction of the intermediate transfer belt 90 (direction shown by arrow B). In addition, the intermediate transfer belt 90 becomes tight in a second area E which is downstream of the receiving roller 64 and upstream of the driving roller 52 in the moving direction of the intermediate transfer belt 90.

Then, the sheet 68 is ejected in the direction shown by arrow C2 from the section between the second transfer roller 66 and the receiving roller 64 that face each other with the intermediate transfer belt 90 nipped therebetween (see FIG. 1). At the when the sheet 68 is ejected, a vacant space is instantaneously provided between the second transfer roller 66 and the receiving roller 64, which have been separated from each other by a distance corresponding to the thickness of the sheet 68. Then, the second transfer roller 66 and the receiving roller 64 quickly come into contact with each other. In that instant, the movement of the intermediate transfer belt 90 in the direction shown by arrow B and the rotation of the receiving roller 64 are accelerated.

Although the rotation of the receiving roller 64 is accelerated, the driving roller 52 continues to rotate at a constant speed. Therefore, the intermediate transfer belt 90 becomes tight in the first area D and the first area D' which are upstream of the receiving roller 64 and downstream of the driving roller 52 in the moving direction of the intermediate transfer belt 90 (direction shown by arrow B). In addition, the intermediate transfer belt 90 becomes slack in the second area B which is downstream of the receiving roller 64 and upstream of the driving roller 52 in the moving direction of the intermediate transfer belt 90.

The variation in the transport speed of the intermediate transfer belt 90 affects the process of transferring the toner images on the photoconductor drums in the image forming units 48 onto the intermediate transfer belt 90, and leads to image blurring and color misregistration.

The image forming apparatus according to the present exemplary embodiment includes a braking unit. The intermediate transfer belt 90 is stretched around a driven roller to which a braking force is applied by the braking unit, and the driven roller or another driven roller is supported so as to be movable in an inward or outward direction of the intermediate transfer belt 90. The movably supported driven roller is moved when the intermediate transfer belt 90 becomes slack or tight owing to the external force that decelerates the rotation of the receiving roller 64 when the sheet 68 enters the second transfer device 60. The braking unit includes a mechanism (hereinafter sometimes referred to as a "brake control mechanism") that converts the displacement of the movably supported driven roller into a relative displacement of a frictional member in a direction for reducing a frictional force between the frictional member and a rotational shaft. Thus, the influence of the external force is reduced.

The movably supported driven roller is also moved when the intermediate transfer belt 90 becomes slack or tight in response to the external force that accelerates the rotation of the receiving roller 64 when the sheet 68 is ejected from the second transfer device 60. In this case, the brake control mechanism automatically increases the pressing force applied to the rotational shaft in the braking unit, so that the influence of the external force is reduced. The detailed operation of the belt driving apparatus will be described below in "2. Exemplary Embodiment of Belt Driving Apparatus".

Thus, in the image forming apparatus according to the present exemplary embodiment, even when a thick recording medium is used, variation in the speed of the intermediate transfer body caused by the external force applied when the recording medium is inserted or ejected may be reduced. As a result, an image with small image blurring and color misregistration may be formed.

The brake control mechanism uses the phenomenon that the intermediate transfer belt 90 becomes slack or tight in response to the external force. Therefore, the brake control mechanism may be provided at either (or both) of the first areas D and D' and the second area E. In the image forming apparatus according to the present exemplary embodiment, the image forming units 48 are arranged in tandem in the first area D'. Therefore, in practice, the brake control mechanism cannot be provided at the first area D'. Accordingly, in the image forming apparatus according to the present exemplary embodiment, the brake control mechanism is provided at either (or both) of the first area D and the second area E.

2. Exemplary Embodiment of Belt Driving Apparatus

Belt driving apparatuses according to exemplary embodiments of the present invention will now be described.

Two exemplary embodiments will be described for each of the case in which a brake control mechanism is provided in the first area D and the case in which a brake control mechanism is provided in the second area F in the image forming apparatus according to the above-described exemplary embodiment.

First Exemplary Embodiment

Figure 4:
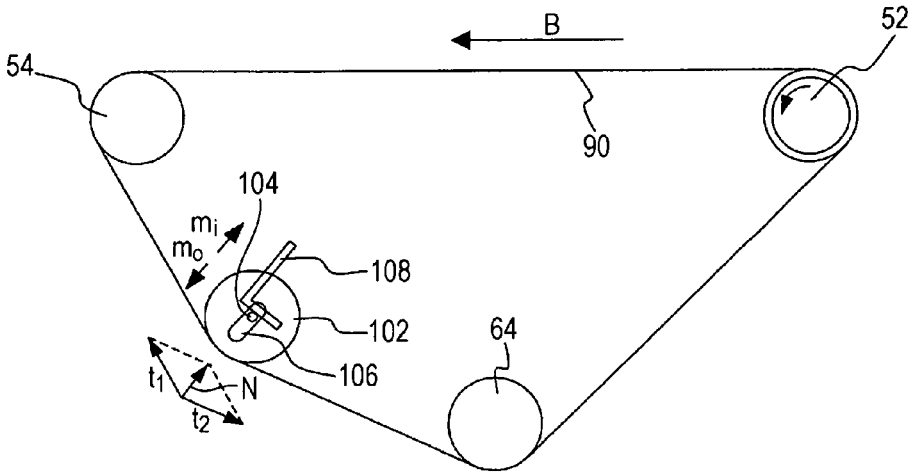
FIG. 4 is a schematic diagram illustrating the structure of a belt driving apparatus according to a first exemplary embodiment of the present invention.

FIG. 4 is a schematic diagram illustrating the structure of a belt driving apparatus according to a first exemplary embodiment of the present invention. FIG. 4 illustrates the transporting system in the image forming apparatus shown in FIG. 1 and the characteristic structure of the present exemplary embodiment. In the present exemplary embodiment, the brake control mechanism is provided at the first area D in the image forming apparatus illustrated in FIG. 1.

The intermediate transfer belt 90 is stretched around plural rollers including the driving roller 52, the support roller 54, a braking displacement roller 102, and the receiving roller 64. The support roller 54 and the braking displacement roller 102 are examples of driven rollers.

The braking displacement roller 102 includes a rotational shaft 104 that projects from both sides of the braking displacement roller 102 in the axial direction and that is inserted through a long hole 106 formed in a guide (not shown) fixed to a housing of the apparatus at each end thereof. The braking displacement roller 102 is supported so as to be movable in a radially inward direction $m_i$ and a radially outward direction $m_o$ with respect to the intermediate transfer belt 90. The braking displacement roller 102 is provided with a braking unit which generates a braking force by generating a frictional force by pressing the rotational shaft 104 against a frictional member 108 that is fixed to the housing of the apparatus at each end of the rotational shaft 104.

A portion of the intermediate transfer belt 90 that is wound around the braking displacement roller 102 receives a tension $t_1$ at the upstream side in the rotational direction thereof (direction shown by arrow B) and a tension $t_2$ at the downstream side in the rotational direction. A normal force N obtained by combining the tensions $t_1$ and $t_2$ press the braking displacement roller 102 in the radially inward direction.

The frictional force generated when the rotational shaft 104 is pressed against the frictional member 108 is based on the force N that presses the braking displacement roller 102 radially inward, the force N being generated by the tensions applied to the intermediate transfer belt 90.

The brake control mechanism according to the present exemplary embodiment is structured as described above.

In the belt driving apparatus according to the present exemplary embodiment, the intermediate transfer belt 90 is rotated in the direction shown by arrow B by the rotation of the driving roller 52. At this time, the braking unit including the frictional member 108 provided on the braking displacement roller 102 applies a braking force against the rotation of the intermediate transfer belt 90 in advance. The braking force and the rotational driving force, which is greater than the braking force, of the driving roller 52 achieve an appropriate balance so that the intermediate transfer belt 90 is rotated by a constant transporting force in the direction shown by arrow B.

In this state, when, for example, the sheet 68 is transported in the direction shown by arrow C1 and enters the section between the receiving roller 64 and the second transfer roller 66 in the second transfer device 60 (see FIGS. 1 and 3), an external force is applied so as to decelerate the rotation of the receiving roller 64. Accordingly, the tensions $t_1$ and $t_2$ decrease in areas on both sides of the braking displacement roller 102, which is upstream of the receiving roller 64 and downstream of the driving roller 52 in the moving direction of the intermediate transfer belt 90 (direction shown by arrow B). Thus, the normal force N, which is the combination of the tensions $t_1$ and $t_2$, also decreases. As a result, the intermediate transfer belt 90 becomes slack, as illustrated in FIG. 5.

Figure 5:
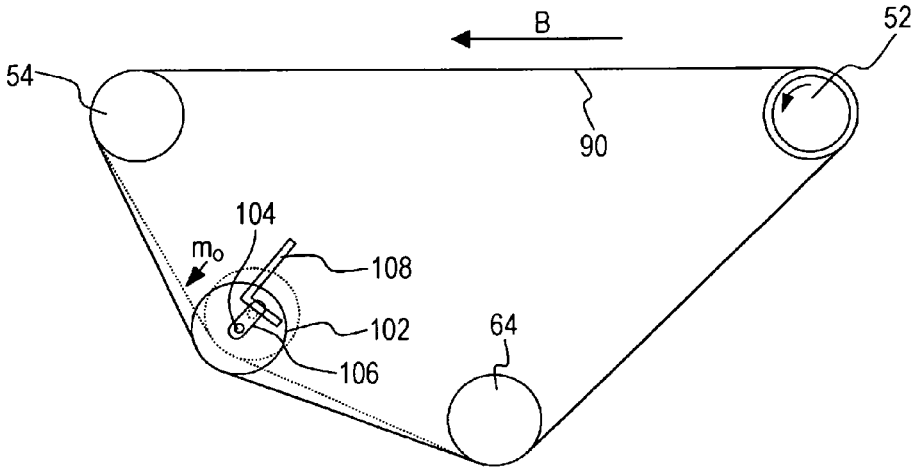
FIG. 5 is a schematic diagram illustrating the manner in which each component moves when an external force is applied so as to decelerate the rotation of a receiving roller in the belt driving apparatus according to the first exemplary embodiment illustrated in FIG. 4.

FIG. 5 is a schematic diagram illustrating the manner in which each component moves when the external force is applied to the receiving roller 64 so as to decelerate the rotation thereof in the belt driving apparatus according to the present exemplary embodiment. The dotted lines in FIG. 5 shows the positions of each component before the application of the external force.

When the intermediate transfer belt 90 becomes slack, the rotational shaft 104 moves along the long hole 106 such that the braking displacement roller 102 moves in the radially outward direction $m_o$. The displacement of the braking displacement roller 102 in the radially outward direction $m_o$ corresponds to a relative displacement of the frictional member 108 in a direction for reducing the frictional force between the rotational shaft 104 and the frictional member 108 in the braking unit. Accordingly, in the present exemplary embodiment, when an external force is applied so as to decelerate the rotation of the receiving roller 64, the braking force applied by the braking unit provided on the braking displacement roller 102 is reduced.

Here, the force that "decelerates the rotation" is a braking force that serves to reduce the rotational driving force. In the present exemplary embodiment, when such a braking force is applied to the receiving roller 64, the braking force applied in advance to the braking displacement roller 102 on the basis of the frictional force applied by the frictional member 108 is reduced. These two braking forces are balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

In addition, according to the present exemplary embodiment, when, for example, the sheet 68 is ejected in the direction shown by arrow C2 from the section between the receiving roller 64 and the second transfer roller 66 in the second transfer device 60 (see FIGS. 1 and 3), an external force is applied so as to accelerate the rotation of the receiving roller 64. Accordingly, the tensions $t_1$ and $t_2$ increase in areas on both sides of the braking displacement roller 102, which is upstream of the receiving roller 64 and downstream of the driving roller 52 in the moving direction of the intermediate transfer belt 90 (direction shown by arrow B). Thus, the normal force N, which is the combination of the tensions $t_1$ and $t_2$, also increases. As a result, the intermediate transfer belt 90 becomes tight, as illustrated in FIG. 6.

Figure 6:
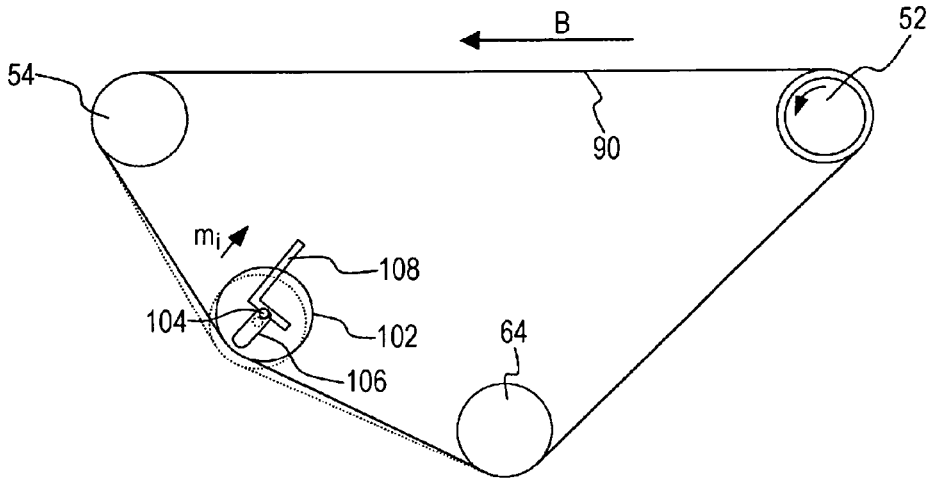
FIG. 6 is a schematic diagram illustrating the manner in which each component moves when an external force is applied so as to accelerate the rotation of the receiving roller in the belt driving apparatus according to the first exemplary embodiment illustrated in FIG. 4.

FIG. 6 is a schematic diagram illustrating the manner in which each component moves when the external force is applied to the receiving roller 64 so as to accelerate the rotation thereof in the belt driving apparatus according to the present exemplary embodiment. The dotted lines in FIG. 6 shows the positions of each component before the application of the external force.

When the intermediate transfer belt 90 becomes tight, the rotational shaft 104 moves along the long hole 106 such that the braking displacement roller 102 moves in the radially inward direction $m_i$. The displacement of the braking displacement roller 102 in the radially inward direction mi corresponds to a relative displacement of the frictional member 108 in a direction for increasing the frictional force between the rotational shaft 104 and the frictional member 108 in the braking unit. Accordingly, in the present exemplary embodiment, when an external force is applied so as to accelerate the rotation of the receiving roller 64, the braking force applied by the braking unit provided on the braking displacement roller 102 is increased.

Here, the force that "accelerates the rotation" is a force that serves to increase the rotational driving force. In the present exemplary embodiment, when the force that increases the driving force is applied to the receiving roller 64, the braking force applied in advance to the braking displacement roller 102 is increased. In the present exemplary embodiment, the increase in the driving force and the increase in the braking force are automatically balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

As described above, in the belt driving apparatus according to the present exemplary embodiment, even when the time at which the external force is expected to be applied is unknown, the braking force may be increased or reduced by directly using the tension variation generated in response to the application of the external force. Therefore, compared to the case in which the variation in speed of the intermediate transfer belt is detected and the driving speed of the driving motor that drives the intermediate transfer belt is feedback-controlled on the basis of the result of the detection, the time delay may be reduced and the variation in the belt transport speed caused by the external force may be more reliably reduced. Moreover, the influence of not only the external force that decelerates the rotation of the receiving roller 64 but also the external force that accelerates the rotation of the receiving roller 64 may be suppressed.

The above-described features may be realized by a mechanical system that is free from an electrical detection system or electronic control, and may therefore be achieved at a low cost.

Moreover, the above-described features may be realized by a small structure with small layout constraints without using a large component, such as a flywheel.

In FIGS. 5 and 6, the displacement of the braking displacement roller 102 is somewhat exaggerated for convenience of drawing and explanation. More specifically, the rotational shaft 104 is drawn as if it is largely separated from the frictional member 108 in FIG. 5, and is drawn as if it is embedded in the frictional member 108 in FIG. 6. However, the braking force based on the frictional force generated by pressing the frictional member 108 against the rotational shaft 104 increases or decreases as the pressing force varies. In other words, the braking force varies when the rotational shaft 104 and the frictional member 108 move relative to each other in microscopic view while being constantly in contact with each other.

Figure 7A:
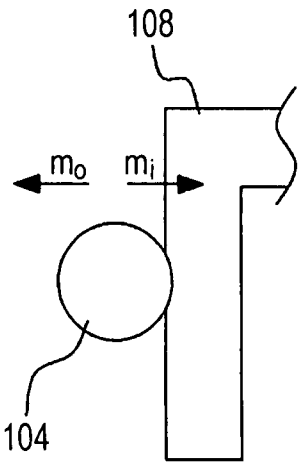
Figure 7B:
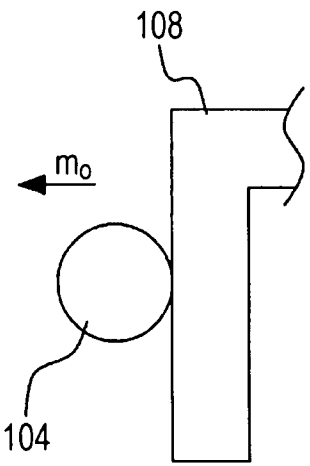
Figure 7C:
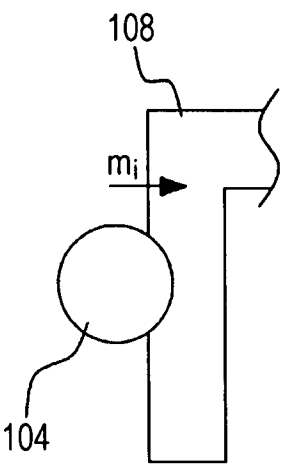

FIGS. 7A to 7D are enlarged views of the frictional member 108 and the rotational shaft 104, illustrating the positional relationship therebetween. FIG. 7A shows a steady state in which the rotational shaft 104 is embedded in the frictional member 108 in microscopic view. When the receiving roller 64 receives an external force and the intermediate transfer belt 90 becomes slack or tight, the rotational shaft 104 moves in the radially outward direction $m_o$ or the radially inward direction $m_i$. FIG. 7B shows the state in which the rotational shaft 104 is moved in the radially outward direction $m_o$ and the frictional force applied to the rotational shaft 104 by the frictional member 108 is reduced so that the braking force is also reduced. FIG. 7C shows the state in which the rotational shaft 104 is moved in the radially inward direction $m_i$ and the rotational shaft 104 is further embedded in the frictional member 108 in microscopic view. In this state, the frictional force is increased so that the braking force is also increased.

Even when the rotational shaft 104 is moved while being constantly in contact with the frictional member 108 and the displacement is microscopically small as described above, the displacement is included in the concept of "relative displacement of the frictional member" according to an exemplary embodiment of the present invention as long as the frictional force between the rotational shaft 104 and the frictional member 108 varies. Thus, in an exemplary embodiment of the present invention, it is not required that the displacement be visually observable.

Figure 7D:
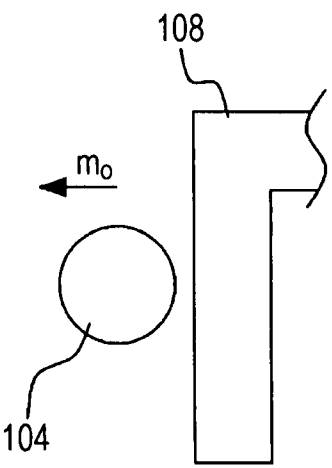

In the state shown in FIG. 7D, the rotational shaft 104 and the frictional member 108 are completely separated from each other, and the braking force applied by the frictional member 108 is eliminated. In this case, the frictional force applied between the rotational shaft 104 and the frictional member 108 is changed to zero from that in the steady state shown in FIG. 7A. Also in this case, the displacement is regarded as an example of "relative displacement of the frictional member" according to an exemplary embodiment of the present invention. The displacement may be adjusted so that the braking force applied by the function of the frictional member 108 is appropriately controlled.

Figure 8:
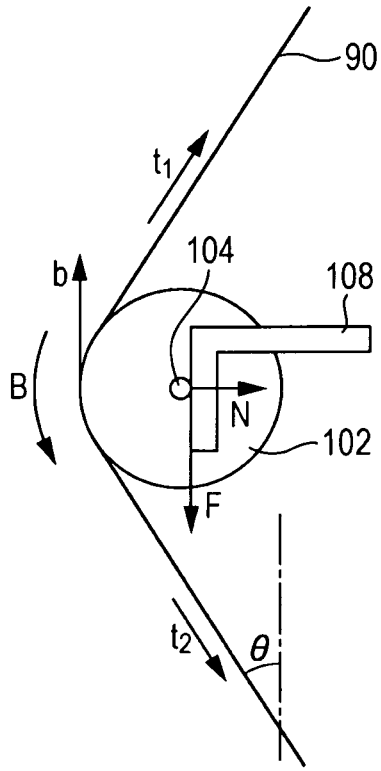
FIG. 8 is an enlarged view of an area around the braking displacement roller included in the belt driving apparatus according to the first exemplary embodiment illustrated in FIG. 4.

FIG. 8 is an enlarged view of an area around the braking displacement roller 102 in the belt driving apparatus according to the present exemplary embodiment illustrated in FIG. 4. The rotational shaft 104 of the braking displacement roller 102 is pressed against the frictional member 108 by the normal force N generated by the tensions $t_1$ and $t_2$ applied to the intermediate transfer belt 90. A frictional force F is generated between the frictional member 108 and the rotational shaft 104. The frictional force F generates a braking force b that reduces the driving force of the intermediate transfer belt 90 in the direction shown by arrow B. When $F_o$ is the frictional force in the steady state, $F_0$ is be expressed as the function of the belt tension $T_0$ ($=t_1=t_2$) as follows:

$$F_0=\mu N=2T_0\mu \sin\theta$$

Here, N is the normal force applied to the frictional member 108 when the tensions $t_1$ and $t_2$ are applied to the intermediate transfer belt 90, θ is the stretching angle of the intermediate transfer belt 90, and μ is the coefficient of friction. In the steady state, the frictional force $F_0$ is constantly applied to the intermediate transfer belt 90 as a load.

When the external force that decelerates the rotation of the receiving roller 64 is applied and the intermediate transfer belt 90 becomes slack, the belt tension of the intermediate transfer belt 90 decreases to, for example, $T_0-\Delta T$. Accordingly, the frictional force F between the frictional member 108 and the rotational shaft 104 changes as follows:

$$F_0-\Delta F=2(T_0-\Delta T)\mu \sin\theta$$

$$(\Delta F=2\Delta T\mu \sin\theta)$$

As is clear from the above equation, the variation in the braking force corresponding to the magnitude of the external load is adjustable by adjusting the stretching angle θ. To ensure the effectiveness of the brake control according to exemplary embodiments of the present invention, the stretching angle θ is desired to be appropriately large. However, theoretically, the effects of exemplary embodiments of the present invention may be obtained as long as θ>0 is satisfied.

The preferable range of the stretching angle θ depends on the other structures and conditions of the apparatus (material and structure of the frictional member, the tensions in the intermediate transfer belt, the magnitude of the external force applied to the receiving roller, the size of the apparatus, the layout freedom of the intermediate transfer belt, etc.), and cannot be generically generalized. The suitable stretching angle θ may be determined as appropriate with reference to the above-described mechanism of variation of the frictional force F based on the above equation while taking into account the other structures and conditions of the apparatus. The discussion regarding the stretching angle of the belt also applies to a third exemplary embodiment described below.

Instead of using the braking displacement roller 102 and the frictional member 108, a fixed member, such as a blade, may be used to directly apply the braking force to the intermediate transfer belt 90. However, since, for example, the belt stretching angle θ is desired to be appropriately large, a large contact force is applied to the intermediate transfer belt 90. Therefore, the intermediate transfer belt 90 will inevitably be scratched and worn in such a case. In contrast, according to the present exemplary embodiment, the braking force is applied to the rotational shaft of the driven roller and is indirectly applied to the belt 90. Thus, the damage of the intermediate transfer belt 90 may be reduced compared to the case in which the braking fore is directly applied to the intermediate transfer belt 90 by using a fixed member.

The frictional member 108 may be made of materials that are generally used as materials of brake pads. For example, elastic materials including various types of rubber materials such as natural rubber, synthetic rubber, and silicone rubber and elastomer, various types of resin materials such as silicon resin, and hard materials such as various types of metal materials may be used.

In the present exemplary embodiment, the rotational shaft 104 of the braking displacement roller (driven roller) 102 is in contact with the plate-shaped frictional member 108 such that the contacting surface of the frictional member 108 is perpendicular to the moving directions (radially inward and outward directions $m_i$ and $m_o$) of the rotational shaft 104. However, the contacting surface of the frictional member 108 is not necessarily perpendicular to the moving directions, and may be somewhat inclined instead. In the case where the contacting surface of the frictional member is inclined, the variation in the frictional force with respect to the displacement may be gradually varied. Thus, the latitude of the brake control may be increased.

The above-described relationship between the rotational shaft of the driven roller and the frictional member of the braking unit, the stretching angle θ, and the structures, materials, etc., of these components are not limited to the present exemplary embodiment and may be applied to all of the other exemplary embodiments described below. Therefore, the explanations thereof are omitted in the exemplary embodiments described below.

Second Exemplary Embodiment

Figure 9:
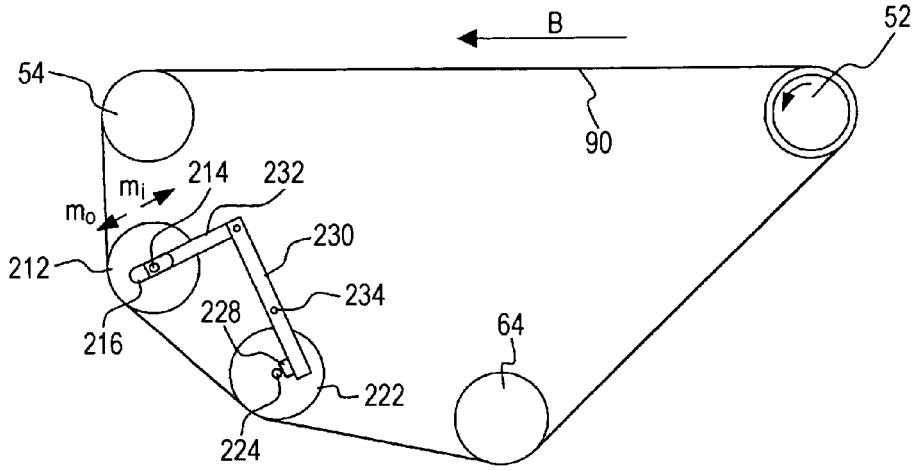
FIG. 9 is a schematic diagram illustrating the structure of a belt driving apparatus according to a second exemplary embodiment of the present invention.

FIG. 9 is a schematic diagram illustrating the structure of a belt driving apparatus according to a second exemplary embodiment of the present invention. FIG. 9 illustrates the transporting system in the image forming apparatus shown in FIG. 1 and the characteristic structure of the present exemplary embodiment. In the present exemplary embodiment, the brake control mechanism is provided at the first area D in the image forming apparatus illustrated in FIG. 1.

The intermediate transfer belt 90 is stretched around plural rollers including the driving roller 52, the support roller 54, a displacement roller 212, a braking roller 222, and the receiving roller 64. The support roller 54, the displacement roller 212, and the braking roller 222 are examples of driven rollers.

The displacement roller 212 includes a rotational shaft 214 that projects from both sides of the displacement roller 212 in the axial direction and that is inserted through a long hole 216 formed in a guide (not shown) fixed to a housing of the apparatus at each end thereof. The displacement roller 212 is supported so as to be movable in a radially inward direction $m_i$ and a radially outward direction $m_o$ with respect to the intermediate transfer belt 90.

A first end of a connecting member 232 is connected to the rotational shaft 214 so as not to hinder the rotation of the rotational shaft 214. A displacement of the rotational shaft 214 in direction $m_i$ or $m_o$ is transmitted to a first end of a long member 230, which is rotatably connected to a second end of the connecting member 232. The long member 230 has a fulcrum 234 at an intermediate point thereof, the fulcrum 234 being rotatably fixed to the housing of the apparatus. Thus, the long member 230 serves as a lever. A frictional member 228 is attached to a second end of the long member 230 that functions as a lever. A rotational shaft 224 that projects from both sides of the braking roller 222 in the axial direction is pressed against the frictional member 228, so that a frictional force is generated. Accordingly, a braking force is generated. The long member 230 is arranged such that the frictional member 228 is pressed against the rotational shaft 224 of the braking roller 222 at the side opposite to the side at which the rotational shaft 224 faces the intermediate transfer belt 90 that is wound around the braking roller 222.

The movement of the first end of the long member 230 caused by the displacement of the rotational shaft 214 in the direction $m_i$ or $m_o$ is converted, by the operation of the lever, into a movement in the opposite direction at a position between the fulcrum 234 and the second end of the long member 230. Accordingly, the frictional member 228 moves relative to the rotational shaft 224.

A portion of the intermediate transfer belt 90 that is wound around the displacement roller 212 receives tensions at the upstream and downstream sides of the displacement roller 212 in the rotational direction thereof (direction shown by arrow B). A normal force obtained by combining the tensions presses the displacement roller 212 in the radially inward direction. Accordingly, the frictional member 228 is pressed against the rotational shaft 224 by a predetermined force by the operations of the connecting member 232 and the long member 230.

The brake control mechanism according to the present exemplary embodiment is structured as described above.

In the belt driving apparatus according to the present exemplary embodiment, the intermediate transfer belt 90 is rotated in the direction shown by arrow B by the rotation of the driving roller 52. At this time, the braking unit including the frictional member 228 provided on the braking roller 222 applies a braking force against the rotation of the intermediate transfer belt 90 in advance. The braking force and the rotational driving force, which is greater than the braking force, of the driving roller 52 achieve an appropriate balance so that the intermediate transfer belt 90 is rotated by a constant transporting force in the direction shown by arrow B.

In this state, when, for example, the sheet 68 is transported in the direction shown by arrow C1 and enters the section between the receiving roller 64 and the second transfer roller 66 in the second transfer device 60 (see FIGS. 1 and 3), an external force is applied so as to decelerate the rotation of the receiving roller 64. Accordingly, the tensions in the intermediate transfer belt 90 decrease in areas on both sides of the displacement roller 212, which is upstream of the receiving roller 64 and downstream of the driving roller 52 in the moving direction of the intermediate transfer belt 90 (direction shown by arrow B). As a result, the intermediate transfer belt 90 becomes slack, as illustrated in FIG. 10.

Figure 10:
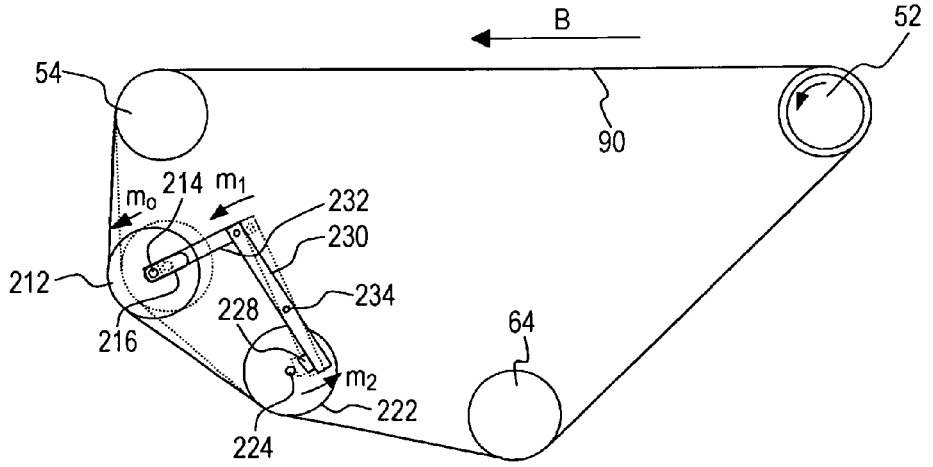
FIG. 10 is a schematic diagram illustrating the manner in which each component moves when an external force is applied so as to decelerate the rotation of a receiving roller in the belt driving apparatus according to the second exemplary embodiment illustrated in FIG. 9.

FIG. 10 is a schematic diagram illustrating the manner in which each component moves when the external force is applied to the receiving roller 64 so as to decelerate the rotation thereof in the belt driving apparatus according to the present exemplary embodiment. The dotted lines in FIG. 10 shows the positions of each component before the application of the external force.

When the intermediate transfer belt 90 becomes slack, the rotational shaft 214 moves along the long hole 216 such that the displacement roller 212 moves in the radially outward direction $m_o$. The displacement of the displacement roller 212 in the radially outward direction $m_o$ is transmitted by the connecting member 232 to the first end of the long member 230, which functions as the point of effort. Accordingly, the first end of the long member 230 moves in the direction shown by arrow $m_1$. Accordingly, the second end of the long member 230, which functions as the point of load, moves in the direction shown by arrow $m_2$. The displacement of the second end of the long member 230 corresponds to a relative displacement of the frictional member 228 in a direction for reducing the frictional force between the rotational shaft 224 and the frictional member 228 in the braking unit. Accordingly, in the present exemplary embodiment, when an external force is applied so as to decelerate the rotation of the receiving roller 64, the braking force applied by the braking unit provided on the braking roller 222 is reduced.

In the present exemplary embodiment, when the braking force due to the external force is applied to the receiving roller 64, the braking force applied in advance to the braking roller 222 is reduced. These two braking forces are balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

In addition, according to the present exemplary embodiment, when, for example, the sheet 68 is ejected in the direction shown by arrow C2 from the section between the receiving roller 64 and the second transfer roller 66 in the second transfer device 60 (see FIGS. 1 and 3), an external force is applied so as to accelerate the rotation of the receiving roller 64. Accordingly, the tensions in the intermediate transfer belt 90 increase in areas on both sides of the displacement roller 212, which is upstream of the receiving roller 64 and downstream of the driving roller 52 in the moving direction of the intermediate transfer belt 90 (direction shown by arrow B). As a result, the intermediate transfer belt 90 becomes tight, as illustrated in FIG. 11.

Figure 11:
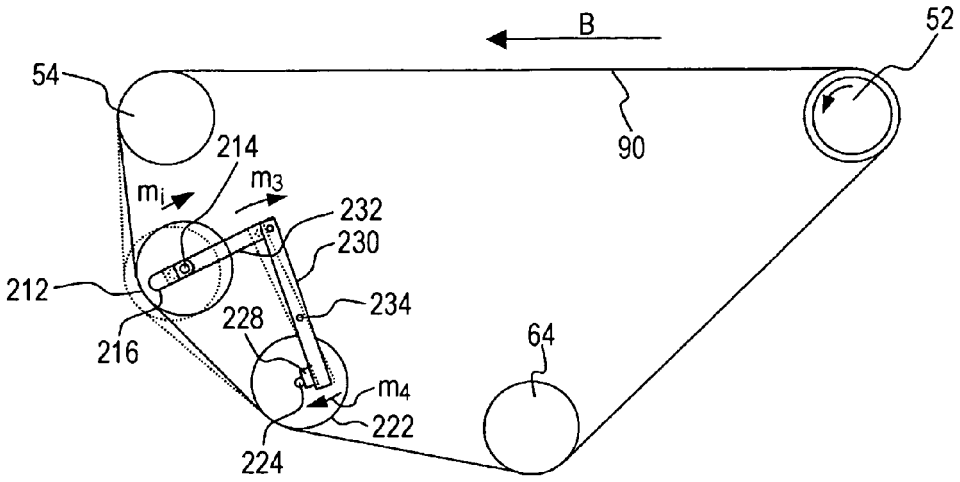
FIG. 11 is a schematic diagram illustrating the manner in which each component moves when an external force is applied so as to accelerate the rotation of the receiving roller in the belt driving apparatus according to the second exemplary embodiment illustrated in FIG. 9.

FIG. 11 is a schematic diagram illustrating the manner in which each component moves when the external force is applied to the receiving roller 64 so as to accelerate the rotation thereof in the belt driving apparatus according to the present exemplary embodiment. The dotted lines in FIG. 11 shows the positions of each component before the application of the external force.

When the intermediate transfer belt 90 becomes tight, the rotational shaft 214 moves along the long hole 216 such that the displacement roller 212 moves in the radially inward direction $m_i$. The displacement of the displacement roller 212 in the radially inward direction $m_i$ is transmitted by the connecting member 232 to the first end of the long member 230. Accordingly, the first end of the long member 230 moves in the direction shown by arrow $m_3$. Accordingly, the second end of the long member 230 moves in the direction shown by arrow $m_4$. The displacement of the second end of the long member 230 corresponds to a relative displacement of the frictional member 228 in a direction for increasing the frictional force between the rotational shaft 224 and the frictional member 228 in the braking unit. Accordingly, in the present exemplary embodiment, when an external force is applied so as to accelerate the rotation of the receiving roller 64, the braking force applied by the braking unit provided on the braking roller 222 is increased.

In the present exemplary embodiment, when the force that increases the driving force is applied to the receiving roller 64, the braking force applied in advance to the braking roller 222 is increased. In the present exemplary embodiment, the increase in the driving force and the increase in the braking force are automatically balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

Similar to FIGS. 5 and 6 which illustrate the first exemplary embodiment, in FIGS. 10 and 11, the displacement of the displacement roller 212 is somewhat exaggerated for convenience of drawing and explanation.

As described above, in the belt driving apparatus according to the present exemplary embodiment, even when the time at which the external force is expected to be applied is unknown, the braking force may be increased or reduced by directly using the tension variation generated in response to the application of the external force. Therefore, compared to the case in which the variation in speed of the intermediate transfer belt is detected and the driving speed of the driving motor that drives the intermediate transfer belt is feedback-controlled on the basis of the result of the detection, the time delay may be reduced and the variation in the belt transport speed caused by the external force may be more reliably reduced. Moreover, the influence of not only the external force that decelerates the rotation of the receiving roller 64 but also the external force that accelerates the rotation of the receiving roller 64 may be suppressed.

The above-described features may be realized by a mechanical system that is free from an electrical detection system or electronic control, and may therefore be achieved at a low cost.

Moreover, the above-described features may be realized by a small structure with small layout constraints without using a large component, such as a flywheel.

In addition, in the present exemplary embodiment, the displacement of the displacement roller 212 is converted into the displacement of the frictional member 228 by using the principle of lever. Therefore, the manner in which the frictional member 228 is pressed against the rotational shaft 224 may be controlled by adjusting the position of the fulcrum 234 of the long member 230 that serves as the lever.

In the present exemplary embodiment, as illustrated in FIGS. 9 to 11, the fulcrum 234 is provided on the long member 230 at a position near the frictional member 228. In this case, even when the force by which the displacement roller 212 is moved when the intermediate transfer belt 90 becomes slack or tight is weak, the force is increased by the principle of lever, and the frictional member 228 may be pressed against the rotational shaft 224 by a larger force. Accordingly, the apparatus may be easily adjusted to effectively apply the braking force with the frictional member 228.

Here, r1 is defined as the distance from the point of effort, which is the connecting point (shown by a circle without a reference numeral in FIGS. 9 to 11) between the connecting member 232 and the long member 230, to the fulcrum 234, and r2 is defined as the distance from the point of load, which is the point at which the frictional member 228 is attached to the long member 230, to the fulcrum 234. In this case, the force which moves the displacement roller 212 when the intermediate transfer belt 90 becomes slack or tight is increased by a factor of r1/r2, and then serves as a force that presses the frictional member 228 against the rotational shaft 224.

The braking force may be increased in the above-described manner. Accordingly, even when, for example, the stretching angle θ, which is described above in the first exemplary embodiment, of the intermediate transfer belt 90 around the displacement roller 212 cannot be set to a sufficiently large angle, the required variation in the braking force may be obtained by using the principle of lever.

Third Exemplary Embodiment

Figure 12:
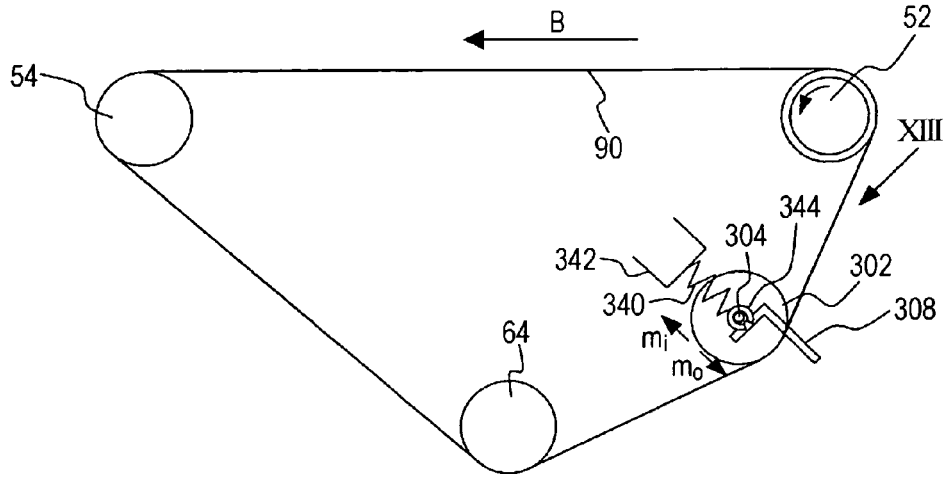
FIG. 12 is a schematic diagram illustrating the structure of a belt driving apparatus according to a third exemplary embodiment of the present invention.

FIG. 12 is a schematic diagram illustrating the structure of a belt driving apparatus according to a third exemplary embodiment of the present invention. FIG. 12 illustrates the transporting system in the image forming apparatus shown in FIG. 1 and the characteristic structure of the present exemplary embodiment. In the present exemplary embodiment, the brake control mechanism is provided at the second area E in the image forming apparatus illustrated in FIG. 1.

The intermediate transfer belt 90 is stretched around plural rollers including the driving roller 52, the receiving roller 64, the support roller 54, and a braking displacement roller 302. The support roller 54 and the braking displacement roller 302 are examples of driven rollers.

Figure 13:
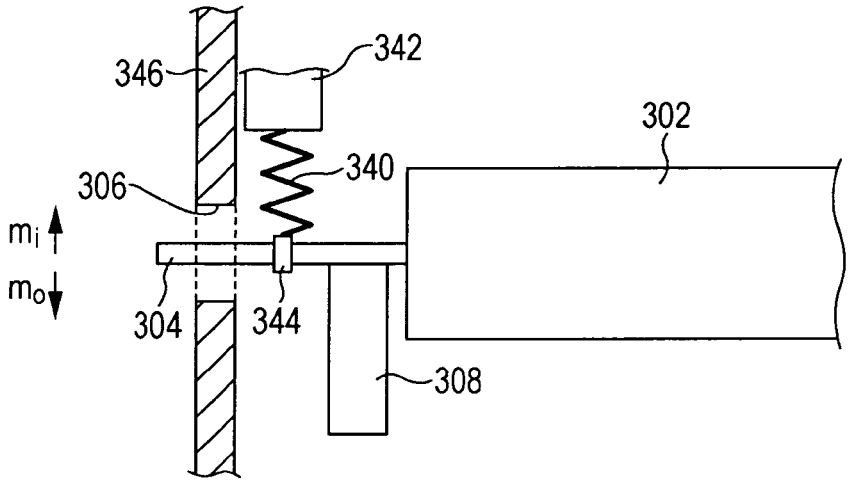
FIG. 13 is an enlarged view of an area around a braking displacement roller included in the belt driving apparatus according to the third exemplary embodiment illustrated in FIG. 12, viewed in a direction shown by arrow XIII.

FIG. 13 is an enlarged view of the braking displacement roller 302 provided with the brake control mechanism and an area around the braking displacement roller 302, viewed in a direction shown by arrow XIII.

The braking displacement roller 302 includes a rotational shaft 304 that projects from both sides of the braking displacement roller 302 in the axial direction and that is inserted through a long hole 306 formed in a guide 346 fixed to a housing of the apparatus at each end thereof. The braking displacement roller 302 is supported so as to be movable in a radially inward direction $m_i$ and a radially outward direction $m_o$ with respect to the intermediate transfer belt 90. The guide 346 having the long hole 306 is not shown in FIG. 12 (the guide 346 is also not shown in FIGS. 14 and 15).

The rotational shaft 304 of the braking displacement roller 302 is rotatably supported by a bearing 344. The bearing 344 is pressed by a spring 340, which is an example of an elastic member, that is fixed to a spring base 342 fixed to the housing of the apparatus. Accordingly, the rotational shaft 304 is pressed by the bearing 344 in the radially outward direction $m_o$ with respect to the intermediate transfer belt 90. A frictional member 308 is arranged so as to face the spring 340 in the pressing direction of the spring 340. The rotational shaft 304 is pressed against the frictional member 308 at each end thereof by the pressing force applied by the spring 340, so that a frictional force is generated. As a result, a braking force is applied. Thus, a braking unit is structured.

A portion of the intermediate transfer belt 90 that is wound around the braking displacement roller 302 receives tensions at the upstream and downstream sides of the braking displacement roller 302 in the rotational direction thereof (direction shown by arrow B). A normal force obtained by combining the tensions presses the braking displacement roller 302 in the radially inward direction. The pressing force of the spring 340 is reduced by this force, and the resulting force serves to press the rotational shaft 304 against the frictional member 308.

The brake control mechanism according to the present exemplary embodiment is structured as described above.

In the belt driving apparatus according to the present exemplary embodiment, the intermediate transfer belt 90 is rotated in the direction shown by arrow B by the rotation of the driving roller 52. At this time, the braking unit including the frictional member 308 provided on the braking displacement roller 302 applies a braking force against the rotation of the intermediate transfer belt 90 in advance. The braking force and the rotational driving force, which is greater than the braking force, of the driving roller 52 achieve an appropriate balance so that the intermediate transfer belt 90 is rotated by a constant transporting force in the direction shown by arrow B.

In this state, when, for example, the sheet 68 is transported in the direction shown by arrow C1 and enters the section between the receiving roller 64 and the second transfer roller 66 in the second transfer device 60 (see FIGS. 1 and 3), an external force is applied so as to decelerate the rotation of the receiving roller 64. Accordingly, the tensions in the intermediate transfer belt 90 increase in areas on both sides of the braking displacement roller 302, which is downstream of the receiving roller 64 and upstream of the driving roller 52 in the moving direction of the intermediate transfer belt 90 (direction shown by arrow B). As a result, the intermediate transfer belt 90 becomes tight, as illustrated in FIG. 14.

Figure 14:
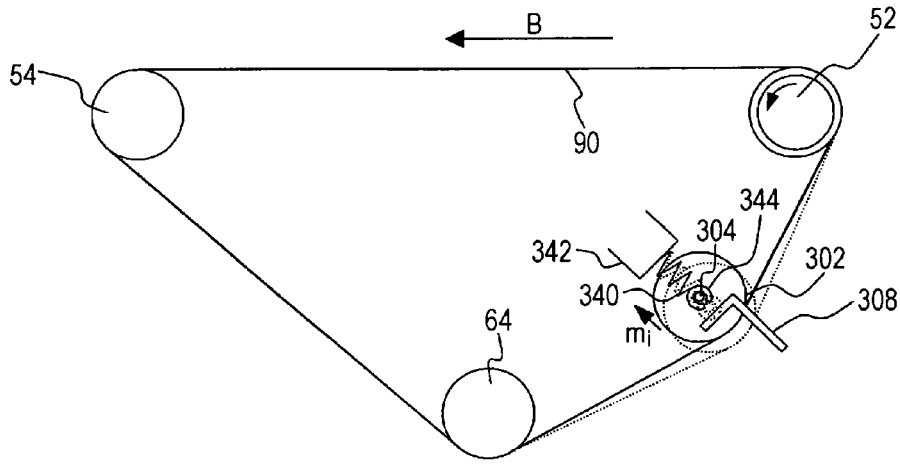
FIG. 14 is a schematic diagram illustrating the manner in which each component moves when an external force is applied so as to decelerate the rotation of a receiving roller in the belt driving apparatus according to the third exemplary embodiment illustrated in FIG. 12.

FIG. 14 is a schematic diagram illustrating the manner in which each component moves when the external force is applied to the receiving roller 64 so as to decelerate the rotation thereof in the belt driving apparatus according to the present exemplary embodiment. The dotted lines in FIG. 14 shows the positions of each component before the application of the external force.

When the intermediate transfer belt 90 becomes tight, the rotational shaft 304 moves along the long hole 306 such that the braking displacement roller 302 moves in the radially inward direction $m_i$. The displacement of the braking displacement roller 302 in the radially inward direction $m_i$ serves to reduce the pressing force of the spring 340 which presses the rotational shaft 304 against the frictional member 308. As a result, the displacement corresponds to a relative displacement of the frictional member 308 in a direction for reducing the frictional force between the rotational shaft 304 and the frictional member 308. Accordingly, in the present exemplary embodiment, when an external force is applied so as to decelerate the rotation of the receiving roller 64, the braking force applied by the braking unit provided on the braking displacement roller 302 is reduced.

In the present exemplary embodiment, when the braking force due to the external force is applied to the receiving roller 64, the braking force applied in advance to the braking displacement roller 302 is reduced. These two braking forces are balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

In addition, according to the present exemplary embodiment, when, for example, the sheet 68 is ejected in the direction shown by arrow C2 from the section between the receiving roller 64 and the second transfer roller 66 in the second transfer device 60 (see FIGS. 1 and 3), an external force is applied so as to accelerate the rotation of the receiving roller 64. Accordingly, the tensions in the intermediate transfer belt 90 decrease in areas on both sides of the braking displacement roller 302, which is downstream of the receiving roller 64 and upstream of the driving roller 52 in the moving direction of the intermediate transfer belt 90 (direction shown by arrow B). As a result, the intermediate transfer belt 90 becomes slack, as illustrated in FIG. 15.

Figure 15:
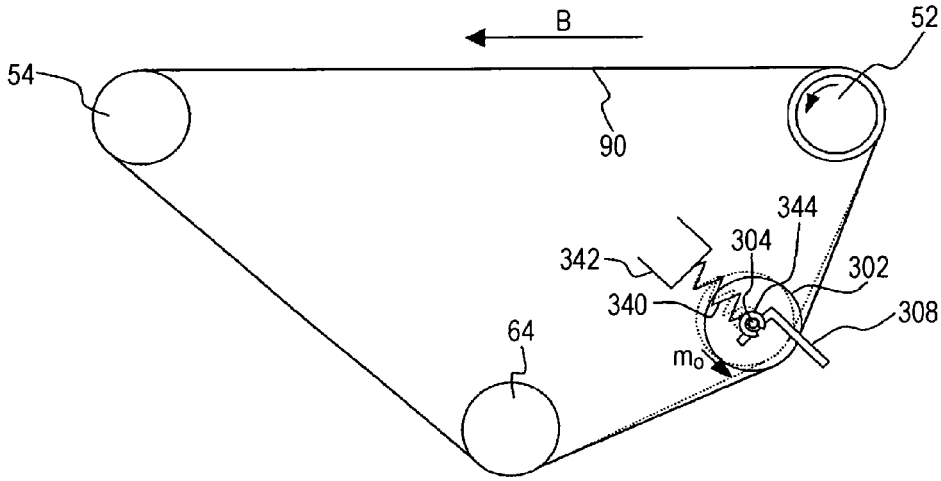
FIG. 15 is a schematic diagram illustrating the manner in which each component moves when an external force is applied so as to accelerate the rotation of the receiving roller in the belt driving apparatus according to the third exemplary embodiment illustrated in FIG. 12.

FIG. 15 is a schematic diagram illustrating the manner in which each component moves when the external force is applied to the receiving roller 64 so as to accelerate the rotation thereof in the belt driving apparatus according to the present exemplary embodiment. The dotted lines in FIG. 15 shows the positions of each component before the application of the external force.

When the intermediate transfer belt 90 becomes slack, the rotational shaft 304 moves along the long hole 306 such that the braking displacement roller 302 moves in the radially outward direction $m_o$. Owing to the displacement of the braking displacement roller 302 in the radially outward direction $m_o$, the pressing force in the radially inward direction $m_i$ based on the tensions in the intermediate transfer belt 90 is reduced. Therefore, the pressing force of the spring 340 which presses the rotational shaft 304 against the frictional member 308 is relatively increased. As a result, the displacement corresponds to a relative displacement of the frictional member 308 in a direction for increasing the frictional force between the rotational shaft 304 and the frictional member 308 in the braking unit. Accordingly, in the present exemplary embodiment, when an external force is applied so as to accelerate the rotation of the receiving roller 64, the braking force applied by the braking unit provided on the braking displacement roller 302 is increased.

In the present exemplary embodiment, when the force that increases the driving force is applied to the receiving roller 64, the braking force applied in advance to the braking displacement roller 302 is increased. In the present exemplary embodiment, the increase in the driving force and the increase in the braking force are automatically balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

Similar to FIGS. 5 and 6 which illustrate the first exemplary embodiment, in FIGS. 14 and 15, the displacement of the braking displacement roller 302 is somewhat exaggerated for convenience of drawing and explanation.

As described above, in the belt driving apparatus according to the present exemplary embodiment, even when the time at which the external force is expected to be applied is unknown, the braking force may be increased or reduced by directly using the tension variation generated in response to the application of the external force. Therefore, compared to the case in which the variation in speed of the intermediate transfer belt is detected and the driving speed of the driving motor that drives the intermediate transfer belt is feedback-controlled on the basis of the result of the detection, the time delay may be reduced and the variation in the belt transport speed caused by the external force may be more reliably reduced. Moreover, the influence of not only the external force that decelerates the rotation of the receiving roller 64 but also the external force that accelerates the rotation of the receiving roller 64 may be suppressed.

The above-described features may be realized by a mechanical system that is free from an electrical detection system or electronic control, and may therefore be achieved at a low cost.

Moreover, the above-described features may be realized by a small structure with small layout constraints without using a large component, such as a flywheel.

Fourth Exemplary Embodiment

Figure 16:
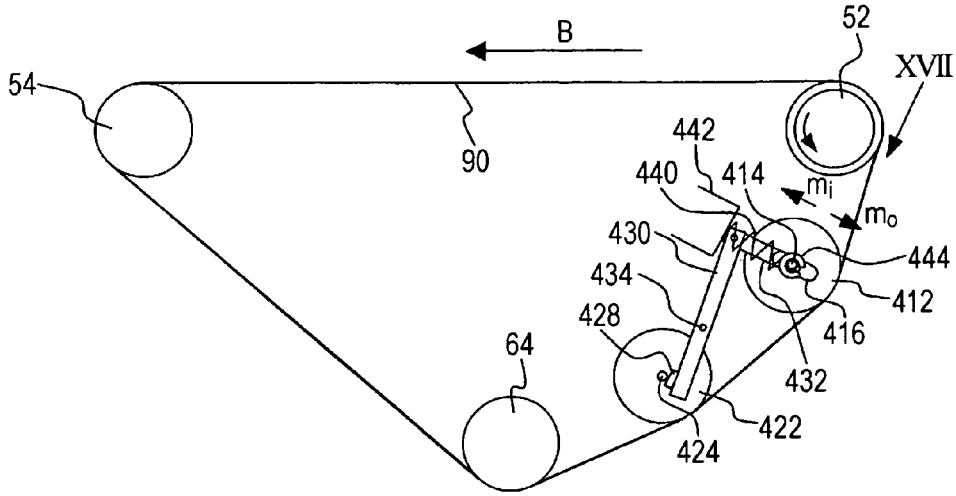
FIG. 16 is a schematic diagram illustrating the structure of a belt driving apparatus according to a fourth exemplary embodiment of the present invention.

FIG. 16 is a schematic diagram illustrating the structure of a belt driving apparatus according to a fourth exemplary embodiment of the present invention. FIG. 16 illustrates the transporting system in the image forming apparatus shown in FIG. 1 and the characteristic structure of the present exemplary embodiment. In the present exemplary embodiment, the brake control mechanism is provided at the second area E in the image forming apparatus illustrated in FIG. 1.

The intermediate transfer belt 90 is stretched around plural rollers including the driving roller 52, the support roller 54, a displacement roller 422, a braking roller 412, and the receiving roller 64. The support roller 54, the displacement roller 412, and the braking roller 422 are examples of driven rollers.

Figure 17:
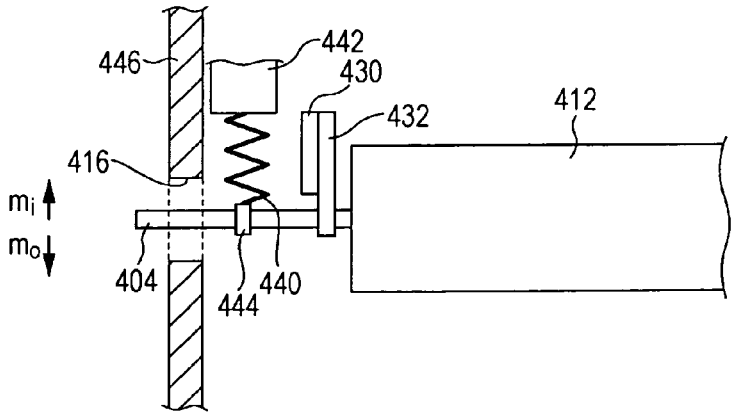
FIG. 17 is an enlarged view of an area around a braking displacement roller included in the belt driving apparatus according to the fourth exemplary embodiment illustrated in FIG. 16, viewed in a direction shown by arrow XVII.

FIG. 17 is an enlarged view of the displacement roller 412 provided with the brake control mechanism and an area around the displacement roller 412, viewed in a direction shown by arrow XVII.

The displacement roller 412 includes a rotational shaft 414 that projects from both sides of the displacement roller 412 in the axial direction and that is inserted through a long hole 416 formed in a guide 446 fixed to a housing of the apparatus at each end thereof. The displacement roller 412 is supported so as to be movable in a radially inward direction $m_i$ and a radially outward direction $m_o$ with respect to the intermediate transfer belt 90. The guide 446 having the long hole 416 is not shown in FIG. 16 (the guide 446 is also not shown in FIGS. 18 and 19).

A rotational shaft 404 of the displacement roller 412 is rotatably supported by a bearing 444. The bearing 444 is pressed by a spring 440, which is an example of an elastic member, that is fixed to a spring base 442 fixed to the housing of the apparatus. Accordingly, the rotational shaft 404 is pressed by the bearing 444 in the radially outward direction $m_o$ with respect to the intermediate transfer belt 90.

A first end of a connecting member 432 is connected to the rotational shaft 414 so as not to hinder the rotation of the rotational shaft 414. A displacement of the rotational shaft 414 in direction $m_i$ or $m_o$ is transmitted to a first end of a long member 430, which is rotatably connected to a second end of the connecting member 432. The long member 430 has a fulcrum 434 at an intermediate point thereof, the fulcrum 434 being rotatably fixed to the housing of the apparatus. Thus, the long member 430 serves as a lever. A frictional member 428 is attached to a second end of the long member 430 that functions as a lever. A rotational shaft 424 that projects from both sides of the braking roller 422 in the axial direction is in contact with the frictional member 428. The long member 430 is arranged such that the frictional member 428 is in contact with the rotational shaft 424 of the braking roller 422 at the side at which the rotational shaft 424 faces the intermediate transfer belt 90 that is wound around the braking roller 422.

The movement of the first end of the long member 430 caused by the displacement of the rotational shaft 414 in the direction $m_i$ or $m_o$ is converted, by the operation of the lever, into a movement in the opposite direction at a position between the fulcrum 434 and the second end of the long member 430. Accordingly, the frictional member 428 moves relative to the rotational shaft 424.

A portion of the intermediate transfer belt 90 that is wound around the displacement roller 412 receives tensions at the upstream and downstream sides of the displacement roller 412 in the rotational direction thereof (direction shown by arrow B). A normal force obtained by combining the tensions functions as a pressing force that presses the displacement roller 412 in the radially inward direction. The pressing force in the radially inward direction and the pressing force applied by the spring 440 to the rotational shaft 414 are balanced such that the pressing force of the spring 440 is larger than the radially inward pressing force. The pressing force of the spring 440 is reduced by the radially inward pressing force, and the resulting force is transmitted through the connecting member 432 and the long member 430 and is applied to the frictional member 428 that is in contact with the rotational shaft 424. Accordingly, the frictional member 428 is pressed against the rotational shaft 424, and a frictional force is generated. As a result, a braking force is generated.

The brake control mechanism according to the present exemplary embodiment is structured as described above.

In the belt driving apparatus according to the present exemplary embodiment, the intermediate transfer belt 90 is rotated in the direction shown by arrow B by the rotation of the driving roller 52. At this time, the braking unit including the frictional member 428 provided on the braking roller 422 applies a braking force against the rotation of the intermediate transfer belt 90 in advance. The braking force and the rotational driving force, which is greater than the braking force, of the driving roller 52 achieve an appropriate balance so that the intermediate transfer belt 90 is rotated by a constant transporting force in the direction shown by arrow B.

In this state, when, for example, the sheet 68 is transported in the direction shown by arrow C1 and enters the section between the receiving roller 64 and the second transfer roller 66 in the second transfer device 60 (see FIGS. 1 and 3), an external force is applied so as to decelerate the rotation of the receiving roller 64. Accordingly, the tensions in the intermediate transfer belt 90 increase in areas on both sides of the displacement roller 412, which is downstream of the receiving roller 64 and upstream of the driving roller 52 in the moving direction of the intermediate transfer belt 90 (direction shown by arrow 13). As a result, the intermediate transfer belt 90 becomes tight, as illustrated in FIG. 18.

Figure 18:
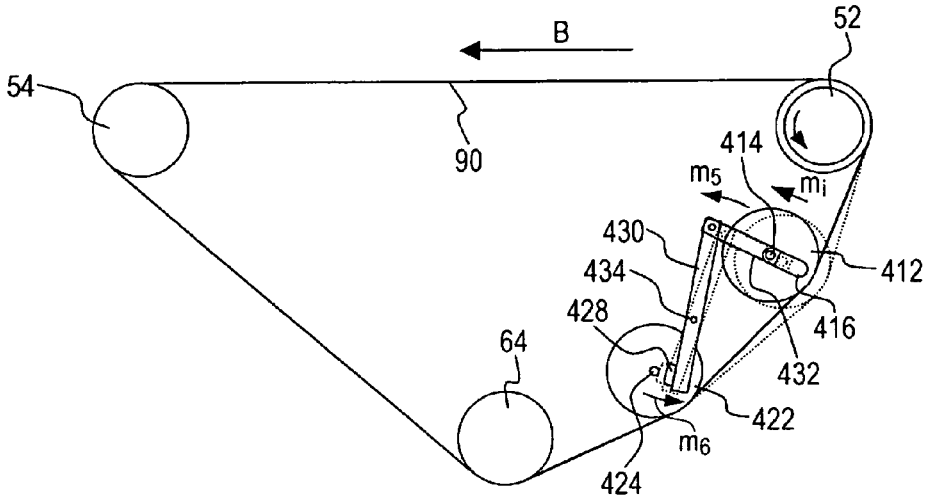
FIG. 18 is a schematic diagram illustrating the manner in which each component moves when an external force is applied so as to decelerate the rotation of a receiving roller in the belt driving apparatus according to the fourth exemplary embodiment illustrated in FIG. 16.

FIG. 18 is a schematic diagram illustrating the manner in which each component moves when the external force is applied to the receiving roller 64 so as to decelerate the rotation thereof in the belt driving apparatus according to the present exemplary embodiment. The dotted lines in FIG. 18 shows the positions of each component before the application of the external force. The bearing 444, the spring 440, and the spring base 442 are not shown in FIG. 18 (these components are also not shown in FIG. 19).

When the intermediate transfer belt 90 becomes tight, the rotational shaft 414 moves along the long hole 416 such that the displacement roller 412 moves in the radially inward direction $m_i$. The displacement of the displacement roller 412 in the radially inward direction $m_i$ is transmitted by the connecting member 432 to the first end of the long member 430, which functions as the point of effort. Accordingly, the first end of the long member 430 moves in the direction shown by arrow $m_5$. Accordingly, the second end of the long member 430, which functions as the point of load, moves in the direction shown by arrow $m_6$. The displacement of the second end of the long member 430 corresponds to a relative displacement of the frictional member 428 in a direction for reducing the frictional force between the rotational shaft 424 and the frictional member 428 in the braking unit. Accordingly, in the present exemplary embodiment, when an external force is applied so as to decelerate the rotation of the receiving roller 64, the braking force applied by the braking unit provided on the braking roller 422 is reduced.

In the present exemplary embodiment, when the braking force due to the external force is applied to the receiving roller 64, the braking force applied in advance to the braking roller 422 is reduced. These two braking forces are balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

In addition, according to the present exemplary embodiment, when, for example, the sheet 68 is ejected in the direction shown by arrow C2 from the section between the receiving roller 64 and the second transfer roller 66 in the second transfer device 60 (see FIGS. 1 and 3), an external force is applied so as to accelerate the rotation of the receiving roller 64. Accordingly, the tensions in the intermediate transfer belt 90 decrease in areas on both sides of the displacement roller 412, which is upstream of the receiving roller 64 and downstream of the driving roller 52 in the moving direction of the intermediate transfer belt 90 (direction shown by arrow B). As a result, the intermediate transfer belt 90 becomes slack, as illustrated in FIG. 19.

Figure 19:
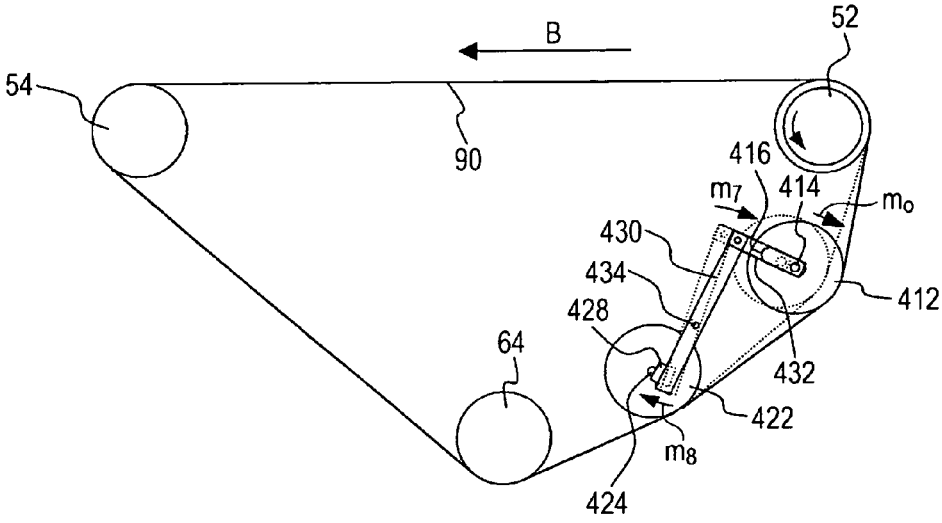
FIG. 19 is a schematic diagram illustrating the manner in which each component moves when an external force is applied so as to accelerate the rotation of the receiving roller in the belt driving apparatus according to the fourth exemplary embodiment illustrated in FIG. 16.

FIG. 19 is a schematic diagram illustrating the manner in which each component moves when the external force is applied to the receiving roller 64 so as to accelerate the rotation thereof in the belt driving apparatus according to the present exemplary embodiment. The dotted lines in FIG. 19 shows the positions of each component before the application of the external force.

When the intermediate transfer belt 90 becomes slack, the rotational shaft 414 moves along the long hole 416 such that the displacement roller 412 moves in the radially outward direction $m_o$. The displacement of the displacement roller 412 in the radially outward direction $m_o$ is transmitted by the connecting member 432 to the first end of the long member 430. Accordingly, the first end of the long member 430 moves in the direction shown by arrow $m_7$. Accordingly, the second end of the long member 430 moves in the direction shown by arrow $m_8$. The displacement of the second end of the long member 430 corresponds to a relative displacement of the frictional member 428 in a direction for increasing the frictional force between the rotational shaft 424 and the frictional member 428 in the braking unit. Accordingly, in the present exemplary embodiment, when an external force is applied so as to accelerate the rotation of the receiving roller 64, the braking force applied by the braking unit provided on the braking roller 422 is increased.

In the present exemplary embodiment, when the force that increases the driving force is applied to the receiving roller 64, the braking force applied in advance to the braking roller 222 is increased. In the present exemplary embodiment, the increase in the driving force and the increase in the braking force are automatically balanced. Accordingly, even when the external force is applied, the total braking force applied to the entire body of the intermediate transfer belt 90 does not vary, or the variation in the total braking force is reduced. As a result, variation in the belt transport speed may be eliminated or reduced.

Similar to FIGS. 5 and 6 which illustrate the first exemplary embodiment, in FIGS. 18 and 19, the displacement of the displacement roller 412 is somewhat exaggerated for convenience of drawing and explanation.

As described above, in the belt driving apparatus according to the present exemplary embodiment, even when the time at which the external force is expected to be applied is unknown, the braking force may be increased or reduced by directly using the tension variation generated in response to the application of the external force. Therefore, compared to the case in which the variation in speed of the intermediate transfer belt is detected and the driving speed of the driving motor that drives the intermediate transfer belt is feedback-controlled on the basis of the result of the detection, the time delay may be reduced and the variation in the belt transport speed caused by the external force may be more reliably reduced. Moreover, the influence of not only the external force that decelerates the rotation of the receiving roller 64 but also the external force that accelerates the rotation of the receiving roller 64 may be suppressed.

The above-described features may be realized by a mechanical system that is free from an electrical detection system or electronic control, and may therefore be achieved at a low cost.

Moreover, the above-described features may be realized by a small structure with small layout constraints without using a large component, such as a flywheel.

In addition, in the present exemplary embodiment, the displacement of the displacement roller 412 is converted into the displacement of the frictional member 428 by using the principle of lever. Therefore, the manner in which the frictional member 428 is pressed against the rotational shaft 424 may be controlled by adjusting the position of the fulcrum 434 of the long member 430 that serves as the lever.

In the present exemplary embodiment, as illustrated in FIGS. 16, 18, and 19, the fulcrum 434 is provided on the long member 430 at a position near the frictional member 428. In this case, even when the force by which the displacement roller 412 is moved when the intermediate transfer belt 90 becomes slack or tight is weak, the force is increased by the principle of lever, and the frictional member 428 may be pressed against the rotational shaft 424 by a larger force. Accordingly, the apparatus may be easily adjusted to effectively apply the braking force with the frictional member 428. The factor by which the force is increased by the lever is similar to that described in the second exemplary embodiment.

The braking force may be increased in the above-described manner. Accordingly, even when, for example, the stretching angle θ, which is described above in the first exemplary embodiment, of the intermediate transfer belt 90 around the displacement roller 412 cannot be set to a sufficiently large angle, the required variation in the braking force may be obtained by using the principle of lever.

Summary of Exemplary Embodiments

Although four exemplary embodiments of the present invention are described above, a belt driving apparatus according to an exemplary embodiment of the present invention is not limited to the above-described exemplary embodiments.

Figure 20:
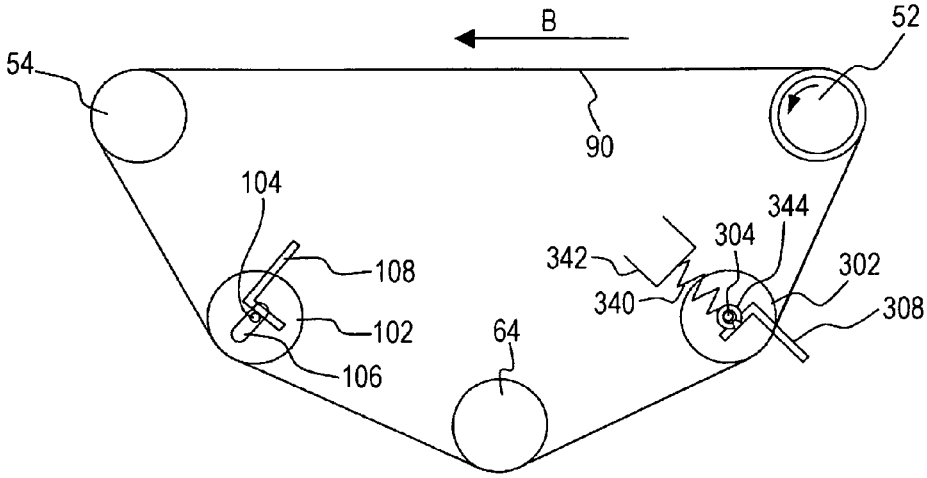
FIG. 20 is a schematic diagram illustrating the structure of a belt driving apparatus including a brake control mechanism provided in a first area and a second area of the endless belt.

For example, in the above-described exemplary embodiment, the brake control mechanism is provided at only one of the first area D and the second area E in the image forming apparatus illustrated in FIG. 1. However, as illustrated in FIG. 20, the brake control mechanism may be provided at each of the first area, which is upstream of the receiving roller and downstream of the driving roller in the rotational direction of the endless belt, and the second area, which is downstream of the receiving roller and upstream of the driving roller in the rotational direction of the endless belt. When the brake control mechanism is provided at each of the first and second areas, the following advantages may be obtained. That is, if the brake control mechanism is provided at only one of the first and second areas, there may be a case in which the variation in the braking force based on the displacement of the frictional member converted from the displacement of the movably supported driven roller is not sufficient for the braking or acceleration in response to deceleration or acceleration of the receiving roller 64 caused by an external force. Even in such a case, the variation in the braking force may be increased.

When, for example, it is difficult to set the belt stretching angle θ described in the first exemplary embodiment to a sufficiently large angle because of the space requirements, the variation range of the braking force may be increased by placing the brake control mechanism at each of the first and second areas. Thus, the favorable effects of an exemplary embodiment of the present invention may be realized.

In the case where the brake control mechanism is provided at each of the first and second areas, the structure of each brake control mechanism is not particularly limited. For example, either of the structures described in the first and second exemplary embodiments may be provided at the first area, and either of the structures described in the third and fourth exemplary embodiments may be provided at the second area. Alternatively, modifications of the structures according to the above-described exemplary embodiments may be used. Thus, the combination of the structures of the brake control mechanisms may be selected as appropriate.

Plural brake control mechanisms may be provided at one or both of the first and second areas. The variation range of the braking force may be increased as the number of brake control mechanisms is increased. However, in such a case, large space is occupied by the brake control mechanisms and the apparatus design becomes complex. In view of these points, when plural brake control mechanisms are provided, they are preferably separately provided in the first and second areas.

In the above-described exemplary embodiments, a tandem full-color image forming apparatus is described as an example of an image forming apparatus according to an exemplary embodiment of the present invention in which a belt driving apparatus according to an exemplary embodiment of the present invention may be included. However, exemplary embodiments of the present invention are not limited to this, and a belt driving apparatus according to an exemplary embodiment of the present invention may also be included in a rotary image forming apparatus which includes a rotation-switching developing device capable of forming toner images of plural colors on the surface of a single image carrier or a single-color image forming apparatus which includes only one toner-image forming unit. In the rotary image forming apparatus, the rotation-switching developing device is used to successively develop toner images of different colors and transfer the developed toner images onto an intermediate transfer body, and then the toner images of all colors are simultaneously transferred onto a recording medium.

Persons skilled in the art may modify the belt driving apparatus and the image forming apparatus according to the exemplary embodiments of the present invention as appropriate on the basis of the knowledge of the related art. The modifications are included in the scope of the present invention as long as they have features of a belt driving apparatus and an image forming apparatus according to an exemplary embodiment of the present invention.

The belt driving apparatuses according to the above-described exemplary embodiments are used to drive an intermediate transfer belt in an image forming apparatus. However, in the case where an image forming apparatus includes another endless belt stretched around plural rollers and one of the rollers receives an external force, a belt driving apparatus according to an exemplary embodiment of the present invention may be used for driving that endless belt.

An intermediate transfer belt included in an image forming apparatus may be traded, transported, and used in the form of a belt unit. More specifically, the belt unit includes the intermediate transfer belt arranged to be stretched around plural rollers and a transfer unit located inside the intermediate transfer belt so as to be opposed to a latent image carrier, such as a photoconductor drum. A belt driving apparatus according to an exemplary embodiment of the present invention may, of course, be applied to a belt unit having such a structure. A belt unit in which an intermediate transfer belt is driven by a belt driving apparatus according to an exemplary embodiment of the present invention corresponds to a belt unit according to an exemplary embodiment of the present invention.

Namely, a belt unit according to an exemplary embodiment of the present invention includes a belt driving apparatus acceding to an exemplary embodiment of the present invention and a transfer unit located inside the belt so as to be opposed to an image carrier that carries a toner image at a surface thereof and that is in contact with an outer peripheral surface of the belt, the toner image on the surface of the image carrier being transferred onto the outer peripheral surface of the belt by the transfer unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt driving apparatus comprising:

an endless belt stretched around a plurality of rollers;

a driving roller that rotationally drives the belt, the driving roller being one of the plurality of rollers;

a receiving roller that receives an external force through the belt, the receiving roller being another one of the plurality of rollers;

one or more driven rollers rotated by rotation of the belt and arranged in an area that is upstream of the receiving roller and downstream of the driving roller in a rotational direction of the belt, the driven rollers being the remaining ones of the plurality of rollers, at least one of the driven rollers being supported to be movable in radially inward and outward directions of the belt in accordance with a tension in the belt; and a braking unit that performs braking by pressing a frictional member against a rotational shaft of one of the driven rollers and generating a frictional force, the braking unit including a mechanism that converts a displacement of the movably supported driven roller in the radially outward direction of the belt into a relative displacement between the rotational shaft and the frictional member, the displacement of the movably supported driven roller being caused when the external force is applied to the receiving roller so as to decelerate rotation thereof.

2. The belt driving apparatus according to claim 1, wherein the frictional member is provided on the movably supported driven roller, and wherein, in the mechanism included in the braking unit, the frictional force applied by the frictional member to the rotational shaft of the movably supported driven roller is generated when the rotational shaft is pressed against the frictional member by a force that is based on the tension in the belt and that presses the movably supported driven roller in the radially inward direction of the belt.

3. The belt driving apparatus according to claim 1, wherein the frictional member is provided on one of the driven rollers that differs from the movably supported driven roller, wherein, in the mechanism included in the braking unit, the frictional member is located to be pressed against the rotational shaft of the driven roller provided with the frictional member at a side opposite to the side at which the rotational shaft faces the belt that is wound around the driven roller provided with the frictional member, and wherein the mechanism includes a long member having a fulcrum at an intermediate point thereof and serving as a lever, an end of the long member being moved by a displacement of the movably supported driven roller such that the other end of the long member is moved so as to move the frictional member.

4. The belt driving apparatus according to claim 1, wherein the driven roller provided with the frictional member and the movably supported driven roller are arranged in each of a first area and a second area, the first area being upstream of the receiving roller and downstream of the driving roller in the rotational direction of the belt and the second area being downstream of the receiving roller and upstream of the driving roller in the rotational direction of the belt, and wherein the mechanism is arranged in the first area, and the braking unit further includes a second mechanism arranged in the second area to convert a displacement of the movably supported driven roller in the second area in the radially inward direction of the belt into a relative displacement between the rotational shaft of the driven roller provided with the frictional member in the second area and the frictional member, the displacement of the movably supported driven roller being caused when the external force is applied to the receiving roller so as to decelerate the rotation thereof.

5. The belt driving apparatus according to claim 4, wherein the frictional member in the first area is provided on the movably supported driven roller in the first area, and wherein, in the mechanism of the braking unit arranged in the first area, the frictional force applied by the frictional member to the rotational shaft of the movably supported driven roller is generated when the rotational shaft is pressed against the frictional member by a force that is based on the tension in the belt and that presses the movably supported driven roller in the radially inward direction of the belt.

6. The belt driving apparatus according to claim 4, wherein the frictional member in the first area is provided on one of the driven rollers that differs from the movably supported driven roller in the first area, wherein, in the mechanism of the braking unit arranged in the first area, the frictional member is located to be pressed against the rotational shaft of the driven roller provided with the frictional member at a side opposite to the side at which the rotational shaft faces the belt that is wound around the driven roller provided with the frictional member, and wherein the mechanism includes a long member having a fulcrum at an intermediate point thereof and serving as a lever, an end of the long member being moved by a displacement of the movably supported driven roller in the first area such that the other end of the long member is moved so as to move the frictional member.

7. The belt driving apparatus according to claim 4, wherein the frictional member in the second area is provided on the movably supported driven roller in the second area, and wherein, in the second mechanism of the braking unit arranged in the second area, the rotational shaft of the movably supported driven roller is rotatably supported while being pressed by an elastic member in the radially outward direction of the belt from the inside of the belt, and the frictional force applied by the frictional member to the rotational shaft is generated when the rotational shaft is pressed against the frictional member by a force with which the elastic member presses the rotational shaft.

8. The belt driving apparatus according to claim 4, wherein the frictional member in the second area is provided on one of the driven rollers that differs from the movably supported driven roller in the second area, wherein, in the second mechanism of the braking unit arranged in the second area, the rotational shaft of the movably supported driven roller is rotatably supported while being pressed by an elastic member in the radially outward direction of the belt from the inside of the belt, the frictional member is located to be pressed against the rotational shaft of the driven roller provided with the frictional member at the side at which the rotational shaft faces the belt that is wound around the driven roller provided with the frictional member, and the frictional force applied by the frictional member to the rotational shaft is generated when the rotational shaft is pressed against the frictional member in response to a force with which the elastic member presses the rotational shaft of the movably supported driven roller, and wherein the second mechanism includes a long member having a fulcrum at an intermediate point thereof and serving as a lever, an end of the long member being moved by a displacement of the movably supported driven roller in the second area such that the other end of the long member is moved so as to move the frictional member.

9. A belt unit comprising:

the belt driving apparatus according to claim 1; and a transfer unit located inside the belt so as to be opposed to an image carrier that carries a toner image at a surface thereof and that is in contact with an outer peripheral surface of the belt, wherein the toner image on the surface of the image carrier is transferred onto the outer peripheral surface of the belt by the transfer unit.

10. An image forming apparatus comprising:

an image carrier;

a toner-image forming unit that forms a toner image on a surface of the image carrier;

an endless intermediate transfer belt stretched around a plurality of rollers;

a first transfer unit that transfers the toner image on the surface of the image carrier onto an outer peripheral surface of the intermediate transfer belt; and a second transfer unit including a transfer roller that is pressed against one of the rollers with the intermediate transfer belt disposed therebetween, the second transfer unit transferring the toner image on the outer peripheral surface of the intermediate transfer belt onto a recording medium supplied from the outside, wherein the intermediate transfer belt is driven by the belt driving apparatus according to claim 1, the intermediate transfer belt serving as the endless belt, the one of the rollers against which the transfer roller is pressed with the intermediate transfer belt disposed therebetween serving as the receiving roller, another one of the rollers serving as the driving roller, and the remaining rollers serving as the driven rollers.

11. A belt driving apparatus comprising:

an endless belt stretched around a plurality of rollers;

a driving roller that rotationally drives the belt, the driving roller being one of the plurality of rollers;

a receiving roller that receives an external force through the belt, the receiving roller being another one of the plurality of rollers;

one or more driven rollers rotated by rotation of the belt and arranged in an area that is downstream of the receiving roller and upstream of the driving roller in a rotational direction of the belt, the driven rollers being the remaining ones of the plurality of rollers, at least one of the driven rollers being supported to be movable in radially inward and outward directions of the belt in accordance with a tension in the belt; and a braking unit that performs braking by pressing a frictional member against a rotational shaft of one of the driven rollers and generating a frictional force, the braking unit including a mechanism that converts a displacement of the movably supported driven roller in the radially inward direction of the belt into a relative displacement between the rotational shaft and the frictional member, the displacement of the movably supported driven roller being caused when the external force is applied to the receiving roller so as to decelerate rotation thereof.

12. The belt driving apparatus according to claim 11, wherein the frictional member is provided on the movably supported driven roller, and wherein, in the mechanism included in the braking unit, the rotational shaft of the movably supported driven roller is rotatably supported while being pressed by an elastic member in the radially outward direction of the belt from the inside of the belt, and the frictional force applied by the frictional member to the rotational shaft is generated when the rotational shaft is pressed against the frictional member by a force with which the elastic member presses the rotational shaft.

13. The belt driving apparatus according to claim 11, wherein the frictional member is provided on one of the driven rollers that differs from the movably supported driven roller, wherein, in the mechanism included in the braking unit, the rotational shaft of the movably supported driven roller is rotatably supported while being pressed by an elastic member in the radially outward direction of the belt from the inside of the belt, the frictional member is located to be pressed against the rotational shaft of the driven roller provided with the frictional member at the side at which the rotational shaft faces the belt that is wound around the driven roller provided with the frictional member, and the frictional force applied by the frictional member to the rotational shaft is generated when the rotational shaft is pressed against the frictional member in response to a force with which the elastic member presses the rotational shaft of the movably supported driven roller, and wherein the mechanism includes a long member having a fulcrum at an intermediate point thereof and serving as a lever, an end of the long member being moved by a displacement of the movably supported driven roller such that the other end of the long member is moved so as to move the frictional member.

14. The belt driving apparatus according to claim 11, wherein the driven roller provided with the frictional member and the movably supported driven roller are arranged in each of a first area and a second area, the first area being upstream of the receiving roller and downstream of the driving roller in the rotational direction of the belt and the second area being downstream of the receiving roller and upstream of the driving roller in the rotational direction of the belt, and wherein the mechanism is arranged in the second area, and the braking unit further includes a second mechanism arranged in the first area to convert a displacement of the movably supported driven roller in the first area in the radially inward direction of the belt into a relative displacement between the rotational shaft of the driven roller provided with the frictional member in the first area and the frictional member, the displacement of the movably supported driven roller being caused when the external force is applied to the receiving roller so as to accelerate the rotation thereof.

15. The belt driving apparatus according to claim 14, wherein the frictional member in the first area is provided on the movably supported driven roller in the first area, and wherein, in the second mechanism of the braking unit arranged in the first area, the frictional force applied by the frictional member to the rotational shaft of the movably supported driven roller is generated when the rotational shaft is pressed against the frictional member by a force that is based on the tension in the belt and that presses the movably supported driven roller in the radially inward direction of the belt.

16. The belt driving apparatus according to claim 14, wherein the frictional member in the first area is provided on one of the driven rollers that differs from the movably supported driven roller in the first area, wherein, in the second mechanism of the braking unit arranged in the first area, the frictional member is located to be pressed against the rotational shaft of the driven roller provided with the frictional member at a side opposite to the side at which the rotational shaft faces the belt that is wound around the driven roller provided with the frictional member, and wherein the mechanism includes a long member having a fulcrum at an intermediate point thereof and serving as a lever, an end of the long member being moved by a displacement of the movably supported driven roller in the first area such that the other end of the long member is moved so as to move the frictional member.

17. The belt driving apparatus according to claim 14, wherein the frictional member in the second area is provided on the movably supported driven roller in the second area, and wherein, in the mechanism of the braking unit arranged in the second area, the rotational shaft of the movably supported driven roller is rotatably supported while being pressed by an elastic member in the radially outward direction of the belt from the inside of the belt, and the frictional force applied by the frictional member to the rotational shaft is generated when the rotational shaft is pressed against the frictional member by a force with which the elastic member presses the rotational shaft.

18. The belt driving apparatus according to claim 14, wherein the frictional member in the second area is provided on one of the driven rollers that differs from the movably supported driven roller in the second area, wherein, in the mechanism of the braking unit arranged in the second area, the rotational shaft of the movably supported driven roller is rotatably supported while being pressed by an elastic member in the radially outward direction of the belt from the inside of the belt, the frictional member is located to be pressed against the rotational shaft of the driven roller provided with the frictional member at the side at which the rotational shaft faces the belt that is wound around the driven roller provided with the frictional member, and the frictional force applied by the frictional member to the rotational shaft is generated when the rotational shaft is pressed against the frictional member in response to a force with which the elastic member presses the rotational shaft of the movably supported driven roller, and wherein the mechanism includes a long member having a fulcrum at an intermediate point thereof and serving as a lever, an end of the long member being moved by a displacement of the movably supported driven roller in the second area such that the other end of the long member is moved so as to move the frictional member.

19. A belt unit comprising:

the belt driving apparatus according to claim 11; and a transfer unit located inside the belt so as to be opposed to an image carrier that carries a toner image at a surface thereof and that is in contact with an outer peripheral surface of the belt, wherein the toner image on the surface of the image carrier is transferred onto the outer peripheral surface of the belt by the transfer unit.

20. An image forming apparatus comprising:

an image carrier;

a toner-image forming unit that forms a toner image on a surface of the image carrier;

an endless intermediate transfer belt stretched around a plurality of rollers;

a first transfer unit that transfers the toner image on the surface of the image carrier onto an outer peripheral surface of the intermediate transfer belt; and a second transfer unit including a transfer roller that is pressed against one of the rollers with the intermediate transfer belt disposed therebetween, the second transfer unit transferring the toner image on the outer peripheral surface of the intermediate transfer belt onto a recording medium supplied from the outside, wherein the intermediate transfer belt is driven by the belt driving apparatus according to claim 11, the intermediate transfer belt serving as the endless belt, the one of the rollers against which the transfer roller is pressed with the intermediate transfer belt disposed therebetween serving as the receiving roller, another one of the rollers serving as the driving roller, and the remaining rollers serving as the driven rollers.

21. A belt driving apparatus comprising:

an endless belt stretched around a plurality of rollers;

a driving roller that rotationally drives the belt, the driving roller being one of the plurality of rollers;

a receiving roller that receives an external force through the belt, the receiving roller being another one of the plurality of rollers;

one or more driven rollers rotated by rotation of the belt, the driven rollers being the remaining ones of the plurality of rollers, at least one of the driven rollers being supported to be movable in radially inward and outward directions of the belt in accordance with a tension in the belt; and a braking unit that performs braking by pressing a frictional member against a rotational shaft of one of the driven rollers and generating a frictional force, the braking unit including a mechanism that converts a displacement of the movably supported driven roller into a relative displacement of the frictional member with respect to the rotational shaft in a direction for reducing the frictional force, the displacement of the movably supported driven roller being caused when the external force is applied to the receiving roller so as to decelerate rotation thereof so that the belt becomes slack in an area upstream of the receiving roller and downstream of the driving roller in a rotational direction of the belt and tight in an area downstream of the receiving roller and upstream of the driving roller in the rotational direction of the belt.

* * * * *